US010259219B2

(12) United States Patent
Seto et al.

(10) Patent No.: US 10,259,219 B2
(45) Date of Patent: Apr. 16, 2019

(54) LIQUID DROPLET EJECTION HEAD AND LIQUID DROPLET EJECTION APPARATUS

(71) Applicant: FUJI XEROX CO., LTD., Tokyo (JP)

(72) Inventors: Shinji Seto, Kanagawa (JP); Kotaro Maeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/726,808

(22) Filed: Oct. 6, 2017

(65) Prior Publication Data

US 2018/0201019 A1 Jul. 19, 2018

(30) Foreign Application Priority Data

Jan. 13, 2017 (JP) ..... 2017-004077
Jan. 18, 2017 (JP) ..... 2017-007057
Jan. 20, 2017 (JP) ..... 2017-008267

(51) Int. Cl.
*B41J 2/14* (2006.01)
*B41J 2/18* (2006.01)
*B41J 2/045* (2006.01)

(52) U.S. Cl.
CPC ..... *B41J 2/14201* (2013.01); *B41J 2/04526* (2013.01); *B41J 2/04581* (2013.01); *B41J 2/14032* (2013.01); *B41J 2/14233* (2013.01); *B41J 2/18* (2013.01); *B41J 2002/14338* (2013.01)

(58) Field of Classification Search
CPC ..... B41J 2/14201; B41J 2/14233; B41J 2/14032; B41J 2/18
See application file for complete search history.

(56) References Cited

U.S. PATENT DOCUMENTS 6,312,097 B1 11/2001 Brugman
2011/0134174 A1* 6/2011 Seto ..... B41J 2/04526 347/10

FOREIGN PATENT DOCUMENTS

JP 55003916 A * 1/1980 ..... B41J 2/045
JP 2000-263782 9/2000
JP 2004-268308 9/2004
JP 2009-208445 9/2009

OTHER PUBLICATIONS

Abstract and machine translation of JP 2009-208445.
Abstract and machine translation of JP 2004-268308.

* cited by examiner

*Primary Examiner* — Geoffrey S Mruk
(74) *Attorney, Agent, or Firm* — Fildes & Outland, P.C.

(57) ABSTRACT

A liquid droplet ejection head includes: a main body member that includes a nozzle that ejects a liquid droplet, a first pressure chamber that is linked to the nozzle, and a second pressure chamber that is linked to the nozzle; a first piezoelectric element that pressurizes the first pressure chamber by applying a first voltage, and causes the liquid droplet to be ejected from the nozzle; and a second piezoelectric element that pressurizes the second pressure chamber by applying a second voltage which is equal to or higher than the first voltage, and deflects the direction of the liquid droplets ejected from the nozzle.

15 Claims, 20 Drawing Sheets

LIQUID DROPLET EJECTION HEAD AND LIQUID DROPLET EJECTION APPARATUS

CROSS-REFERENCE TO RELATED APPLICATIONS

This application is based on and claims priorities under 35 USC 119 from Japanese Patent Application No. 2017-007057 filed on Jan. 18, 2017, Japanese Patent Application No. 2017-004077 filed on Jan. 13, 2017 and Japanese Patent Application No. 2017-008267 filed an Jan. 20, 2017.

BACKGROUND

Technical Field

The present invention relates to a liquid droplet ejection head and a liquid droplet ejection apparatus.

Related Art

In an image forming apparatus in which a first pressure chamber and a second pressure chamber are provided to one nozzle, a first piezoelectric element to which a voltage is applied pressurizes the first pressure chamber to eject a liquid droplet from the nozzle, and a second piezoelectric element to which a voltage smaller than the voltage applied to the first piezoelectric element is applied pressurizes the second pressure chamber, and then, the direction of the liquid droplet is deflected. In this image forming apparatus, the capacity of the first pressure chamber is similar to the capacity of the second pressure chamber.

SUMMARY

According to an aspect of the invention, there is provided a liquid droplet ejection head that includes:

a main body member that includes a nozzle that ejects a liquid droplet, a first pressure chamber that is linked to the nozzle, and a second pressure chamber that is linked to the nozzle;

a first piezoelectric element that pressurizes the first pressure chamber by applying a first voltage, and causes the liquid droplet to be ejected from the nozzle; and a second piezoelectric element that pressurizes the second pressure chamber by applying a second voltage which is equal to or higher than the first voltage, and deflects the direction of the liquid droplets ejected from the nozzle.

BRIEF DESCRIPTION OF THE DRAWINGS

Exemplary embodiment(s) of the present invention will be described in detail based on the following figures, wherein.

DETAILED DESCRIPTION

First Embodiment

Examples of a liquid droplet ejection head and an image forming apparatus in a first embodiment of the invention will be described according to FIGS. 1 to 12. An arrow H illustrated in each drawing indicates a vertical direction and a vertical direction of the apparatus, an arrow W indicates a horizontal direction and a width direction of the apparatus, and an arrow D indicates a horizontal direction and a depth direction of the apparatus.

Overall Configuration

Figure 10:
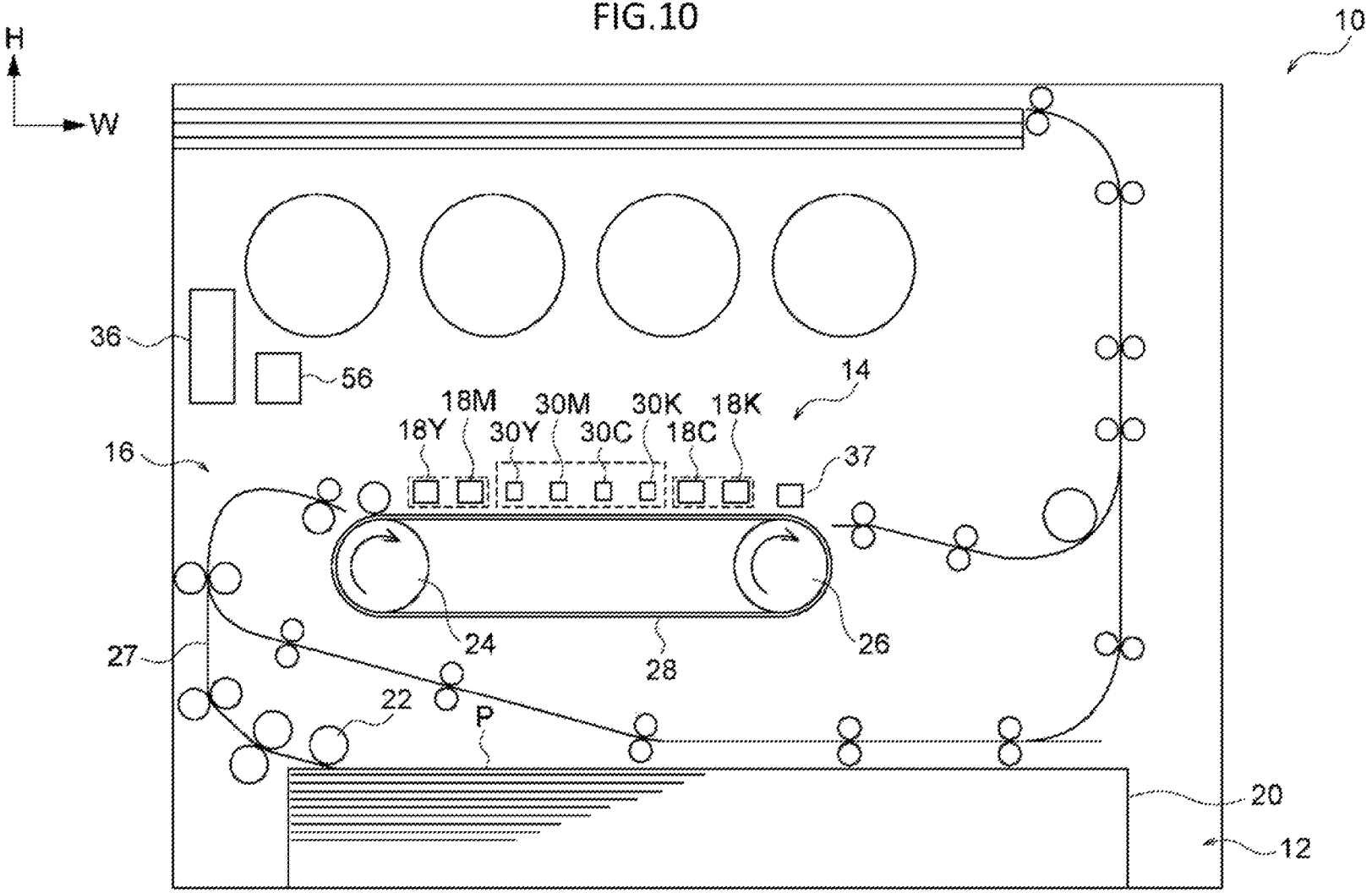
FIG. 10 is a schematic configuration diagram illustrating an image forming apparatus in the first embodiment of the invention.

As illustrated in FIG. 10, an image forming device 10 is an inkjet recording device and includes a sheet accommodation unit 12 in which a sheet member P is accommodated as a recording medium, an image forming unit 14 for forming an image on the sheet member P, and a transport unit 16 for transporting the sheet member P. Furthermore, the image forming device 10 includes a control unit 36 for controlling each unit and a power source 56 for supplying power to each unit. The image forming device 10 is an example of a liquid droplet ejection apparatus. In addition, details of the power source 56 will be described later.

Sheet Accommodation Unit

The sheet accommodation unit 12 includes a sheet accommodation member 20 on which plural sheet members P are loaded and a feeding roll 22 for feeding the uppermost sheet member P loaded on the sheet accommodation member 20 to the transport route 27 of the sheet member P.

Transport Unit

The transport unit 16 includes plural transport rollers (reference numerals omitted) for feeding the sheet member P fed from the sheet accommodation unit 12 along the transport route 27. The transport unit 16 is an example of a transport member.

Image Forming Unit

The image forming unit 14 includes a driving roll 24 that rotatably drives, a driven roll 26 that is rotatably disposed on the right side in the drawing with respect to the driving roll 24, and a transport belt 28 wound around the driving roll 24 and the driven roll 26. The transport belt 28 transports the sheet member P while holding the sheet member P by electrostatic adsorption.

Furthermore, the image forming unit 14 includes four liquid droplet ejection heads 30Y, 30M, 30C, and 30K corresponding to each of four colors of yellow (Y), magenta (M), cyan (C), and black (K) that eject ink droplets (examples of liquid droplets) on the transported sheet member P. The liquid droplet ejection heads 30Y, 30M, 30C and 30K are disposed in this order from the upstream side in the transport direction of the sheet member P above the transport belt 28 between the driving roll 24 and the driven roll 26.

In a case of distinguishing yellow (Y), magenta (M), cyan (C), and black (K), alphabets will be added to the end of the code, and in a case of not distinguishing the colors, the alphabet at the end of the code will be omitted.

Furthermore, the image forming unit 14 includes clean members 18Y, 18M, 18C, and 18K for cleaning each of the liquid droplet ejection heads 30. The liquid droplet ejection head 30 will be described later. In addition, in the transport direction of the sheet member P, a reading sensor 37 that reads the image formed on the sheet member P by the ink droplets ejected from the liquid droplet ejection head 30 is disposed on the downstream side of the liquid droplet ejection head 30 and above the transport belt 28.

Figure 9:
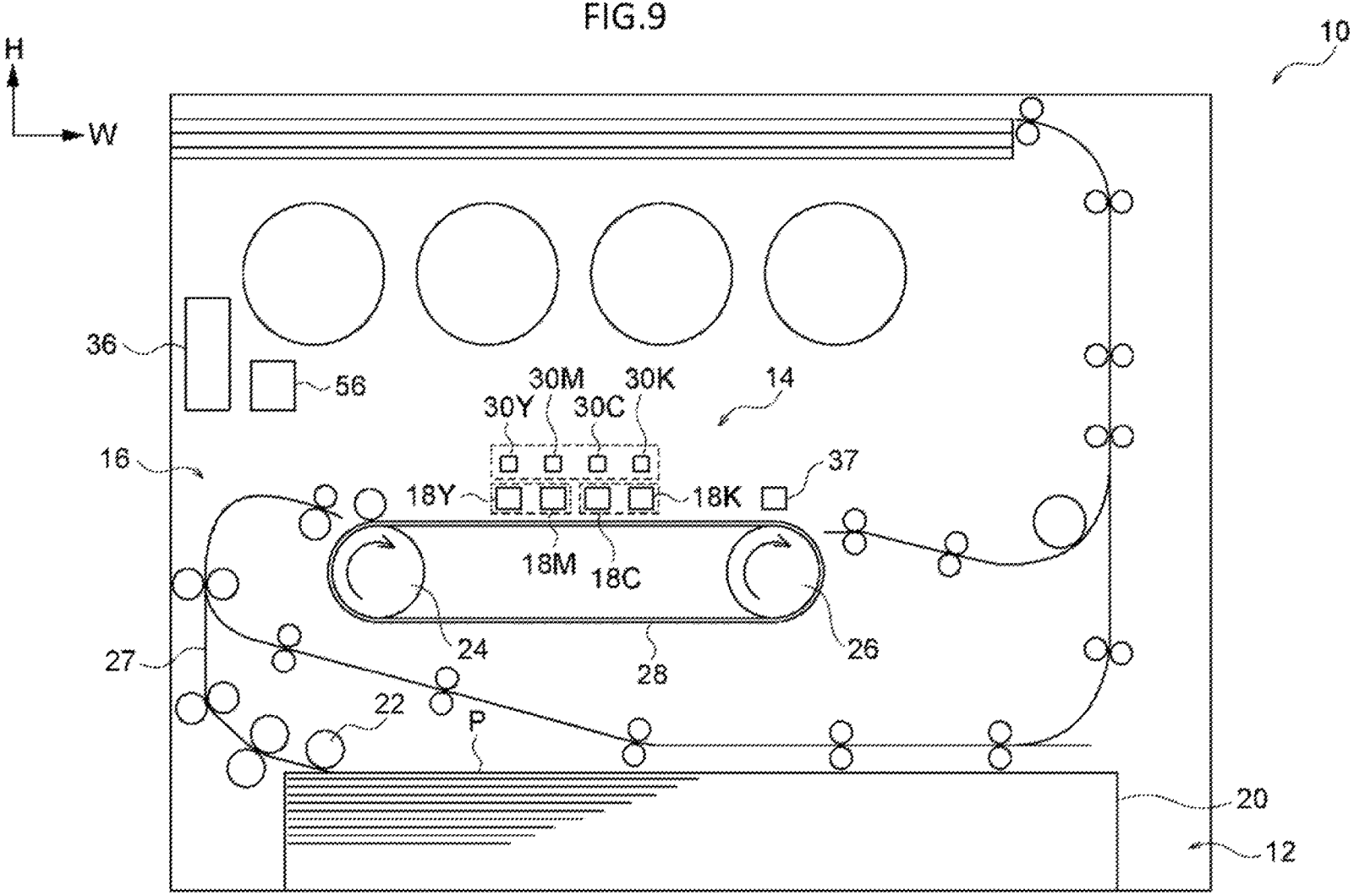
FIG. 9 is a schematic configuration diagram illustrating an image forming apparatus in the first embodiment of the invention.

In this configuration, in a case where the ink droplet is ejected from the liquid droplet ejection head 30 to the sheet member P, as illustrated in FIG. 10, the liquid droplet ejection head 30 and the clean members 18 are separated from each other in the width direction of the apparatus, and the liquid droplet ejection head 30 faces the transport belt 28. On the other hand, in a case where the clean members 18 cleans the liquid droplet ejection head 30, as illustrated in FIG. 9, the liquid droplet ejection head 30 is separated from the transport belt 28 and the clean members 18 moves, and thus, the liquid droplet ejection head 30 and the clean members 18 are disposed to face each other in the vertical direction of the apparatus.

Operation of Overall Configuration

Next, an operation of forming an image on the sheet member P using the image forming device 10 will be described.

The uppermost sheet member P loaded on the sheet accommodation member 20 is fed to the transport route 27 by the feeding roll 22. The sheet member P fed to the transport route 27 is transported along the transport route 27 by plural transport rollers. Furthermore, the sheet member P is electro-statically adsorbed (held) to the transport belt 28.

The sheet member P electro-statically adsorbed to the transport belt 28 is transported in the main scanning direction by the circulating transport belt 28. Then, an image is formed on the sheet member P by the ink droplets (the liquid droplets) ejected from the liquid droplet ejection head 30 of each color.

The sheet member P on which the image is formed is separated from the transport belt 28 using a separation plate (not illustrated). The separated sheet member P is transported by plural transport rollers along the transport route 27 and discharged to the outside of the apparatus.

Configuration of Main Units

Next, the liquid droplet ejection head 30, the power source 56, and the like will be described.

Figure 1:
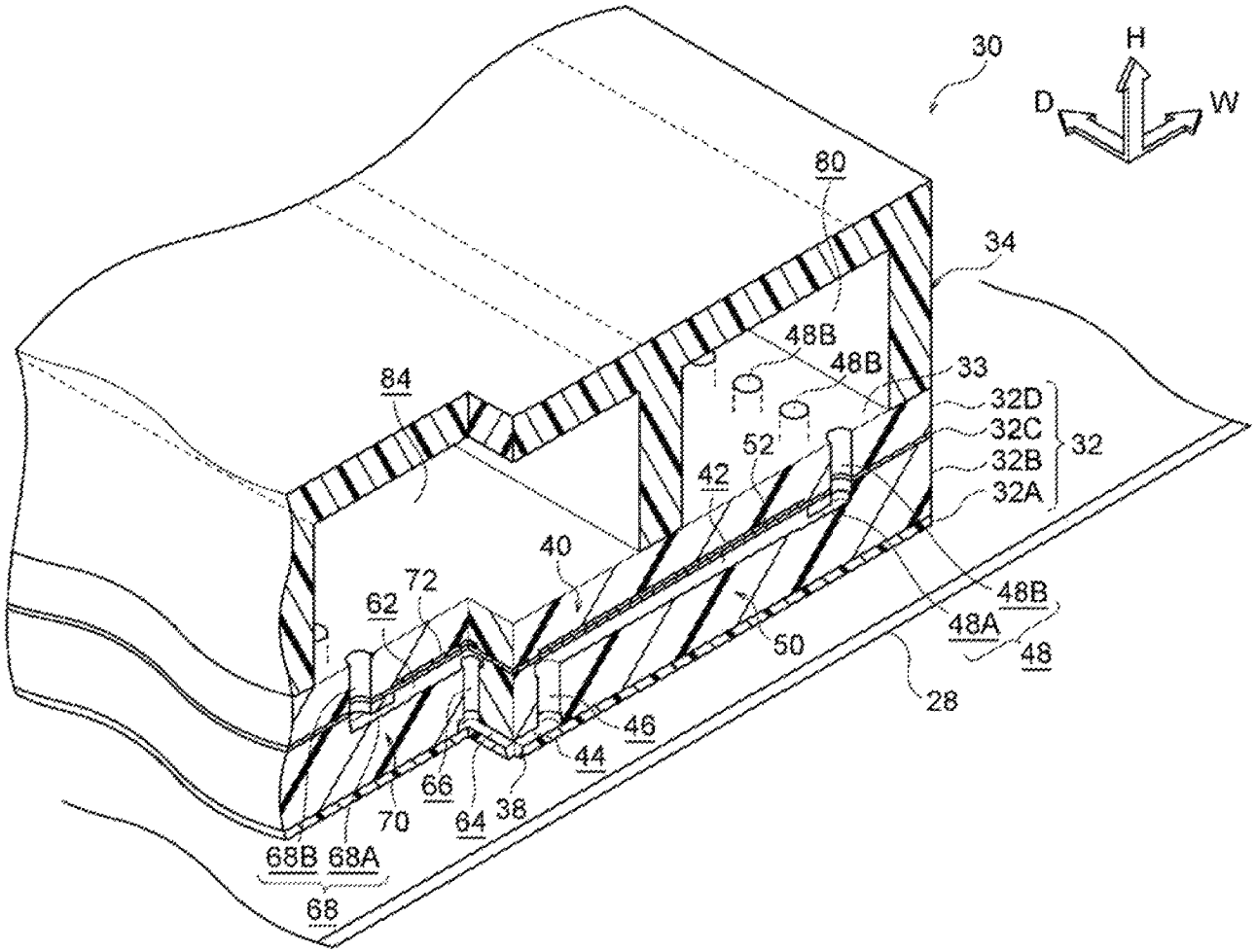
FIG. 1 is a sectional perspective view illustrating a liquid droplet ejection head in a first embodiment of the invention.

The liquid droplet ejection head 30 has a rectangular parallelepiped shape extending in the depth direction of the apparatus, and as illustrated in FIG. 1, the head includes a main body member 32 facing the transport belt 28 transporting the sheet member P, and a flow path member 34 superimposed on the main body member 32 from above.

Main Body Member

Figure 2:
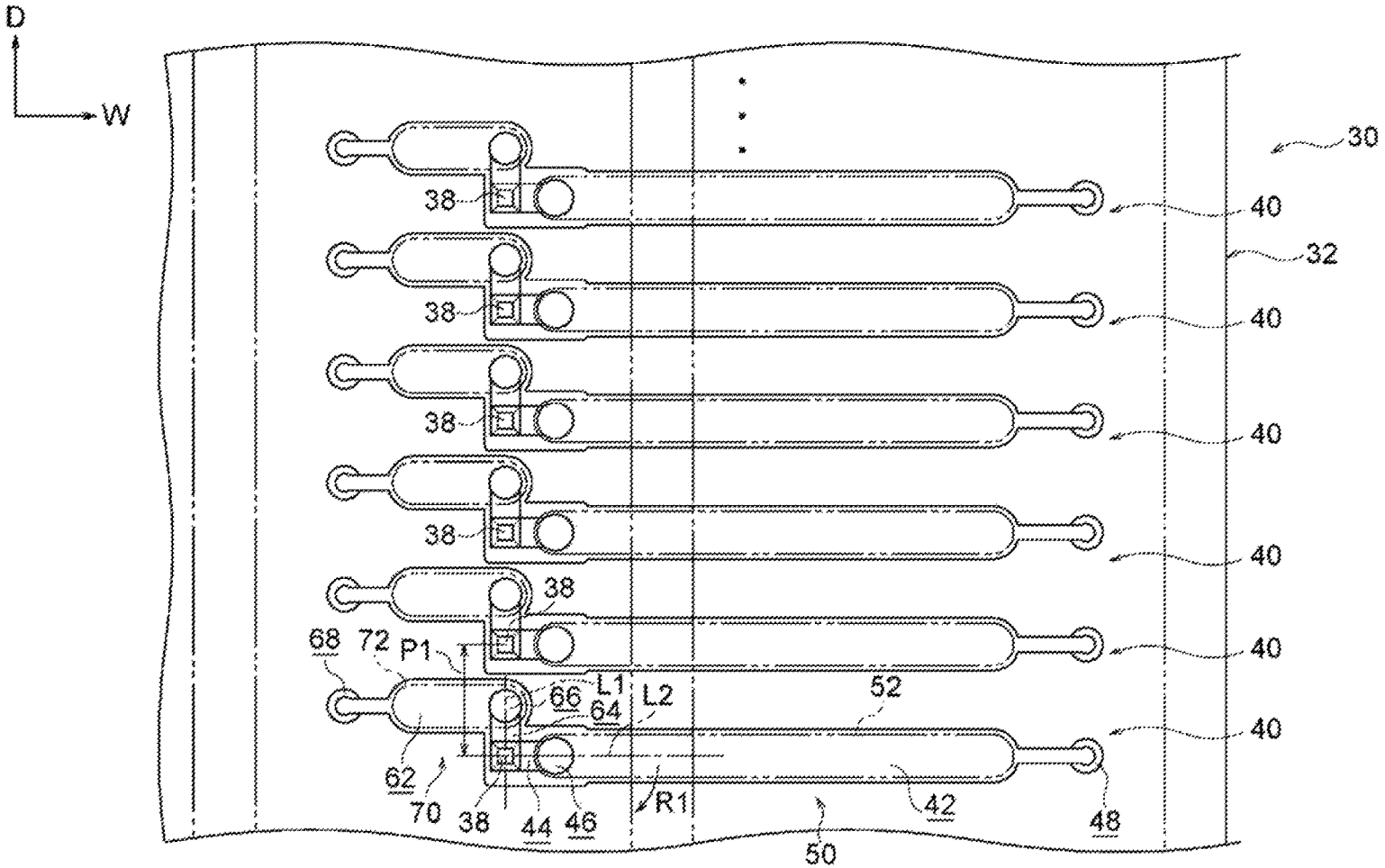
FIG. 2 is a plan view illustrating the liquid droplet ejection head in the first embodiment of the invention.
Figure 3:
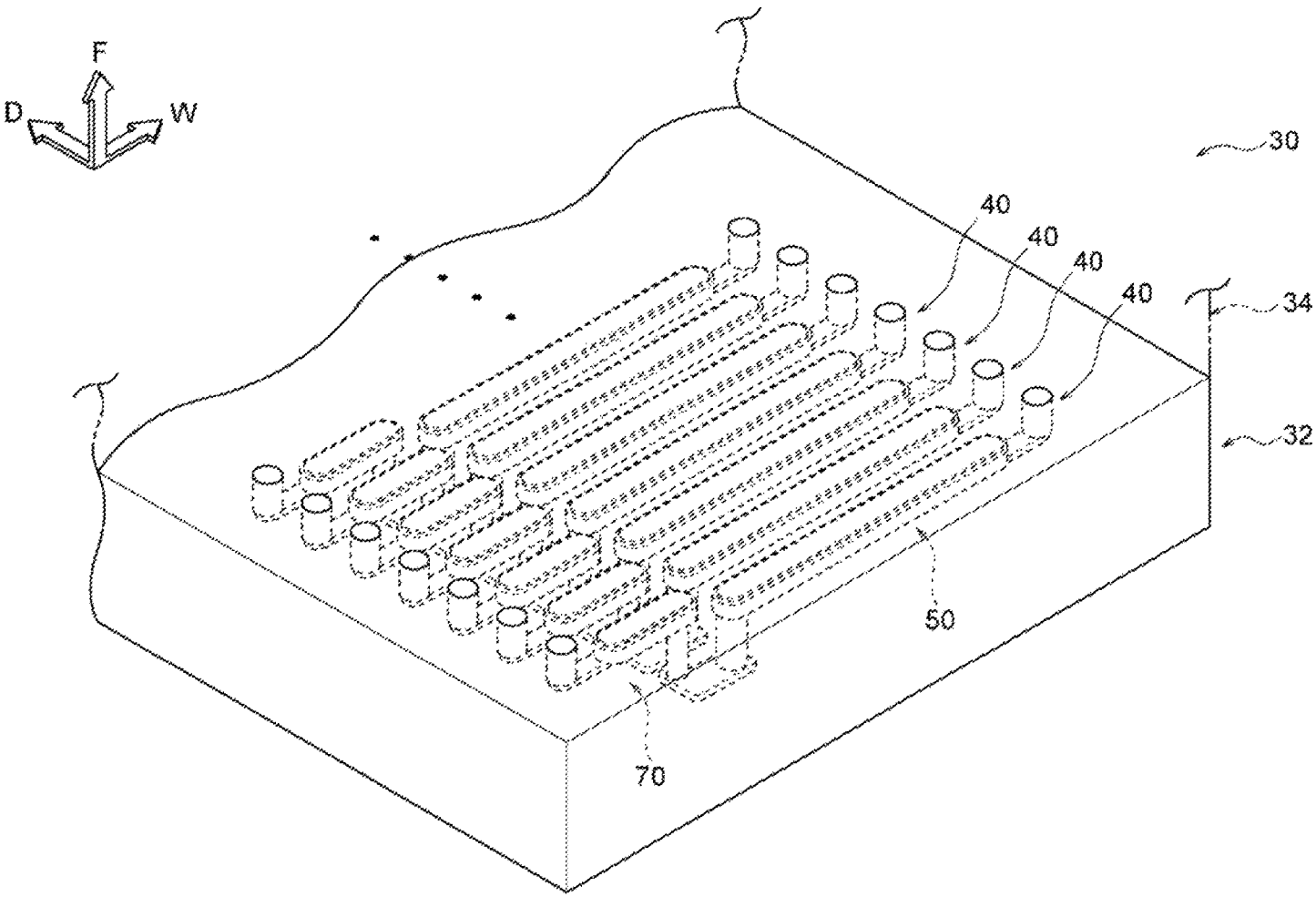
FIG. 3 is a perspective view illustrating the liquid droplet ejection head in the first embodiment of the invention.

The main body member 32 has a rectangular parallelepiped shape extending in the depth direction of the apparatus, and is formed with a nozzle plate 32A, a lower layer portion 32B, a vibration plate 32C, and an upper layer portion 32D that are stacked in this order. The nozzle plate 32A is formed with polyimide resin, the lower layer portion 32B and the upper layer portion 32D are formed with silicon resin, and the vibration plate 32C is a stainless steel plate. As illustrated in FIGS. 2 and 3, plural ejectors 40 are disposed on the main body member 32 in the apparatus depth direction (sub-scanning direction).

As illustrated in FIG. 1 and FIG. 2, the ejector 40 has nozzles 38 for ejecting the ink droplets. The nozzles 38 are formed on the nozzle plate 32A facing the transport belt 28, and have a rectangular shape when viewed from above. Furthermore, the ejector 40 includes an ejection unit 50 disposed on one side (the right side in FIG. 2) in the apparatus width direction with respect to the nozzles 38 and a deflection portion 70 disposed on the back side (the upper side in FIG. 2) in the apparatus depth direction with respect to the nozzles 38.

Ejection Unit

The ejection unit 50 includes a first pressure chamber 42 filled with an ink (an example of liquid), a first passage 44 linked to the nozzles 38, a connecting flow path 46 connecting the first pressure chamber 42 and the first passage 44, and an auxiliary flow path 48. Furthermore, the ejection unit 50 includes a first piezoelectric element 52 for pressurizing the first pressure chamber 42 to eject the ink droplet (an example of the liquid droplet) from the nozzles 38, and a wiring for applying a voltage to the first piezoelectric element 52 (refer to FIG. 6C).

The first passage 44 is formed on the lower layer portion 32B, and extends to one side (the right side in the drawing) in the apparatus width direction (main scanning direction) with the upper side of the nozzles 30 as the base end. The cross section of this first passage 44 has a rectangular shape extending in the apparatus depth direction. The bottom surface forming the first passage 44 is configured with a nozzle plate 32A.

The connecting flow path 46 is formed on the lower layer portion 32B and extends to the upper side with a tip of the first passage 44 as the base end. The cross section of this connecting flow path 46 has a circular shape.

The first pressure chamber 42 is formed on the lower layer portion 32B and extends to one side in the apparatus width direction with the tip of the connecting flow path 46 as the base end. The cross section of the first pressure chamber 42 has a rectangular shape extending in the apparatus depth direction. Furthermore, when viewed from the upper side, both end portions of the first pressure chamber 42 has an arc shape with respect to the rectangle extending in the apparatus width direction (refer to FIG. 2). The top surface forming the first pressure chamber 42 is configured with the vibration plate 32C.

The auxiliary flow path 48 is formed on the lower layer portion 32B, on the vibration plate 32C, and on the upper layer portion 32D, and includes a horizontal portion 48A extending in one direction of the apparatus width direction with the tip of the first pressure chamber 42 as the base end and a vertical portion 48B extending from the tip of the horizontal portion 48A to the upper side. The cross section of the horizontal portion 48A has a thinner rectangular shape as compared to the cross section of the first pressure chamber 42, and the cross section of the vertical portion 48B has a circular shape. In addition, the upper end of the vertical portion 48B reaches the upper surface 33 of the main body member 32, and the vertical portion 48B is open to the outside or the main body member 32.

The first piezoelectric element 52 is mounted on the opposite side of the first pressure chamber 42 with crossing the vibration plate 32C. In addition, both side portions the outer edge of the first piezoelectric element 52 has an arc shape with respect to a rectangle extending in the apparatus width direction when viewed from the upper side, and the first piezoelectric element 52 is smaller than the first pressure chamber 42 (refer to FIG. 2).

In this configuration, the first piezoelectric element 52 to which a voltage (a first voltage) is applied pressurizes the first pressure chamber 42 by displacing the vibration plate 32C, and applies pressure to the ink with which the first pressure chamber 42 is filled. As a result, a pressure wave is transferred to the nozzles 38 side from the first pressure chamber 42 via the connecting flow path 46 and the first passage 44, and then, the first piezoelectric element 52 ejects the ink droplet downward from the nozzles 38.

Deflection Unit

The deflection unit 70 includes a second pressure chamber 62 filled with the ink, a second passage 64 finked to the nozzles 38, a connecting flow path 66 connecting the second pressure chamber 62 and the second passage 64, and the auxiliary flow path 68. Furthermore, the deflection unit 70 includes a second piezoelectric element 72 which pressurizes the second pressure chamber 62 and deflects the ejection direction of the ink droplets ejected from the nozzles 38, and the wiring (not illustrated) for applying the voltage to the second piezoelectric element 72 (refer to FIGS. 6A and 6B).

The second passage 64 is formed on the lower layer portion 32B and extends to the back side in the apparatus depth direction (sub-scanning direction) with the upper side of the nozzles 38 as the base end. The cross section of the second passage 64 has a rectangular shape extending in the apparatus width direction. The bottom surface forming the second passage 64 is configured with the nozzle plate 32A.

When viewed from the upper side, the direction to which the second passage 64 extends (refer to L1 in FIG. 2) and the direction to which the first passage 44 of the ejection unit 50 extends (L2 in FIG. 2) intersect each other (orthogonal to each other in the present embodiment) (refer to FIG. 2). In other words, when viewed from the ejection direction from which the ink droplet is ejected from the nozzles 38, the direction to which the first passage 44 extends and the direction to which the second passage 64 extends intersect each other. In a case of arranging the first passage 44 and the second passage 64 so as to intersect each other, it is preferable to dispose the passages so as to be orthogonal to each other as illustrated in FIG. 2.

The connecting flow path 66 is formed on the lower layer portion 32B and extends to the upper side with the tip of the second passage 64 as the base end. The cross section of the connecting flow path 66 has a circular shape. The bottom surface forming the connecting flow path 66 is configured with the nozzle plate 32A and the top surface forming the connecting flow path 66 is configured with the vibration plate 32C.

The second pressure chamber 62 is formed on the lower layer portion 32B and extends to the other side (the left side in the drawing) of the apparatus width direction with the tip of the connecting flow path 66 as the base end. The cross section of the second pressure chamber 62 has a rectangular shape extending in the apparatus depth direction. Furthermore, when viewed from the upper side, both sides of the second pressure chamber 62 has an arc shape with respect to the rectangle extending in the apparatus width direction (main scanning direction) as (refer to FIG. 2). In addition, the length of the second pressure chamber 62 in the apparatus depth direction is shorter than the length of the first pressure chamber 42 in the apparatus depth direction. The capacity of the second pressure chamber 62 is smaller than the capacity of the first pressure chamber 42. Here, the fact that the capacity is small means that the area of a portion where the pressure chamber and the piezoelectric element are opposed is small, which results the capacity small.

The auxiliary flow path 68 is formed on the lower layer portion 32B, on the vibration plate 32C, and on the upper layer portion 32D, and includes the horizontal portion 68A extending toward the other end side of the apparatus width direction and the vertical portion 68B extending from the tip to the upper side of the horizontal portion 68A with the tip of the second pressure chamber 62 as the base end. The cross section of the horizontal portion 68A has a thinner rectangular shape compared with the cross section of the second pressure chamber 62, and the cross section of the vertical portion 68B has a circular shape. The upper end of the vertical portion 68B reaches the upper surface 33 of the main body member 32, and the vertical portion 68B is open to the outside of the main body member 32.

The second piezoelectric element 72 is mounted on the opposite side of the second pressure chamber 62 with crossing the vibration plate 32C. In addition, when viewed from the upper side, both end portions of the outer edge of the second piezoelectric element 72 has an arc shape with respect to a rectangle extending in the apparatus width direction, and the second piezoelectric element 72 is smaller than the second pressure chamber 62 (refer to FIG. 2).

In this configuration, the second piezoelectric element 72 to which a voltage (a second voltage) having a magnitude same as the voltage (the first voltage) applied to the first piezoelectric element 52 is applied pressurizes the second pressure chamber 62 by displacing the vibration plate 32C. The second piezoelectric element 72 applies pressure to the ink with which the first pressure chamber 62 is filled. As a result, a pressure wave is transferred to the nozzles 30 side from the first pressure chamber 62 via the connecting flow path 66 and the first passage 64, and then, the ejection direction of the ink droplet ejected from the nozzles 30 is deflected (changed).

Others

Next, a relationship between a waveform (hereinafter, "ejection waveform") of a voltage (hereinafter, a "first voltage") applied to the first piezoelectric element 52, a waveform (hereafter, a "deflection waveform") of a voltage (hereinafter a "second voltage") applied to the second piezoelectric element 72, and the ejection direction of the ink droplet ejected from the nozzles 38, will be described.

Figure 7B:
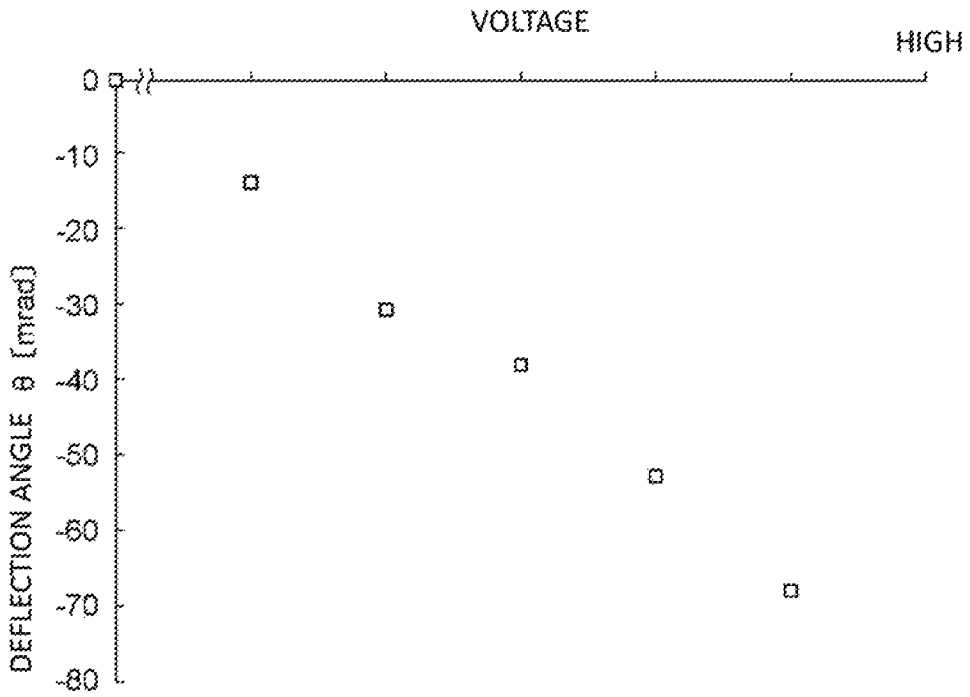
FIGS. 7A and 7B are graphs illustrating experimental results of the liquid droplet ejection head in the first embodiment of the invention.
Figure 7A:
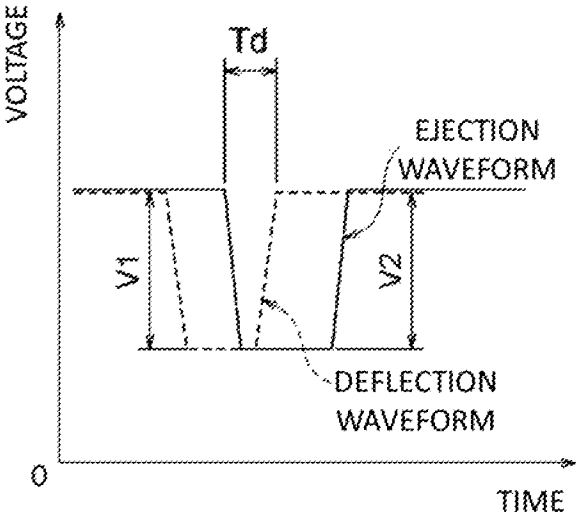

The ejection waveform and the deflection waveform are illustrated in graph in FIG. 7A, and the relationship between a deflection angle θ (the ejection direction) of the ink droplet ejected from the nozzles 38 and the second voltage is illustrated in FIG. 7B.

A vertical axis in FIG. 7A represents the voltage and a horizontal axis represents a time. A start point of the deflection waveform is earlier than a start point of the ejection waveform, and an end point of the deflection waveform is delayed with respect to the start point of the ejection waveform by a time Td. That is, the time Td is a time from the start point of the ejection waveform to the end point of the deflection waveform. In addition, as described above, the second voltage (V1 in the graph) has a magnitude same as that of the first voltage (V2 in the graph).

Figure 4:
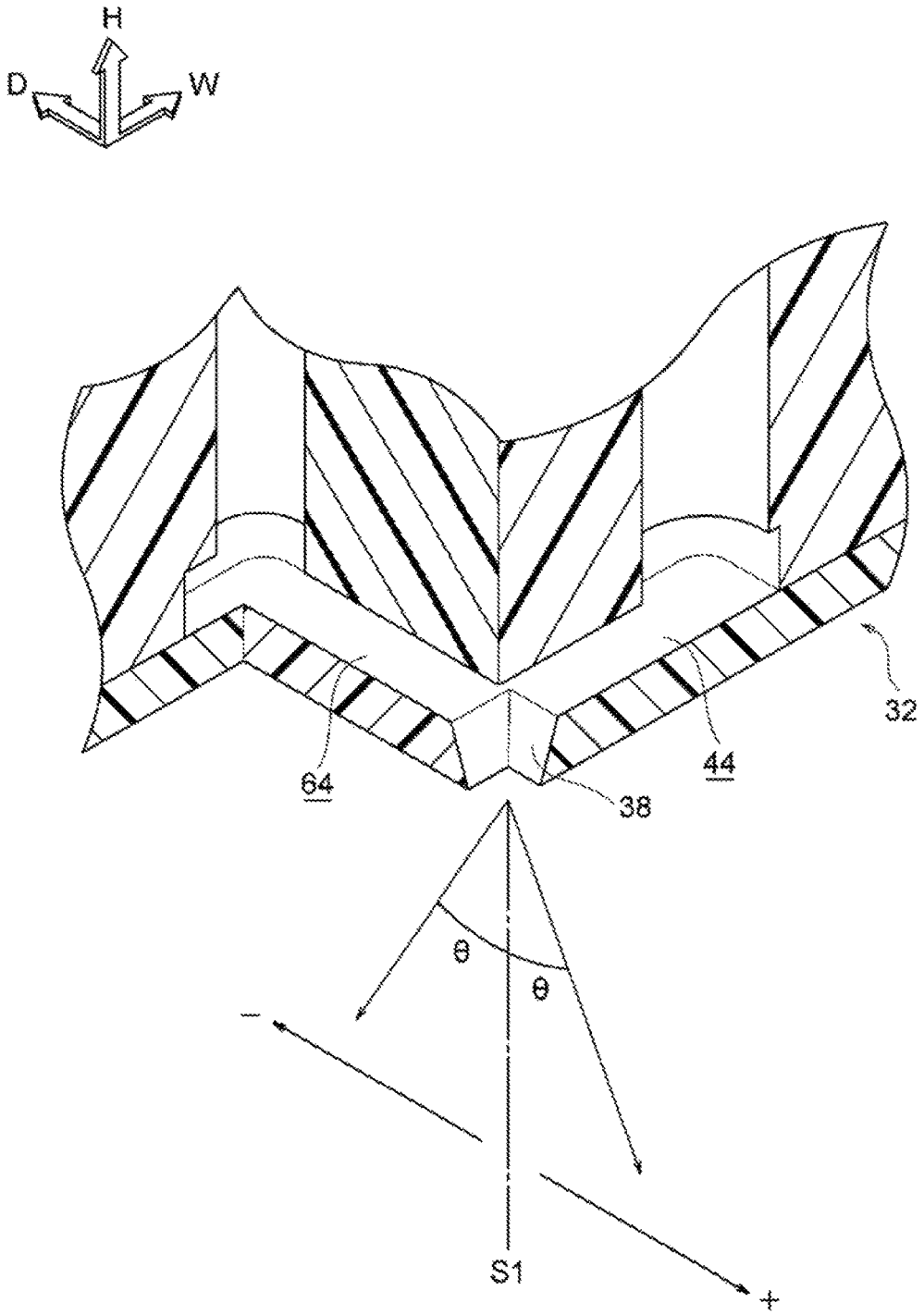
FIG. 4 is an enlarged sectional perspective view illustrating the liquid droplet ejection head in the first embodiment of the invention.

A vertical axis in the graph in FIG. 7B represents the deflection angle θ of ink droplets ejected from nozzles 38 and the horizontal axis represents the second voltage. As illustrated in FIG. 4, in the deflection angle θ, the direction inclining toward the front side of the apparatus depth direction is defined as "+", and the direction inclining to the back side of the apparatus depth direction is defined as "−" with a case where the ink droplet is ejected downward from the nozzles 38 as the reference (S1 in the drawing). The time Td from the start point of the ejection waveform to the end point of the deflection waveform and the first voltage are not changed.

Then, as illustrated in the graph in FIG. 7B, when the second voltage is increased, the deflection angle θ increases toward the "−" direction side. In a case where the voltage is not applied to the second piezoelectric element 72, the deflection angle θ is "0", and the ink droplets are ejected downward from the nozzles 30.

Figure 8:
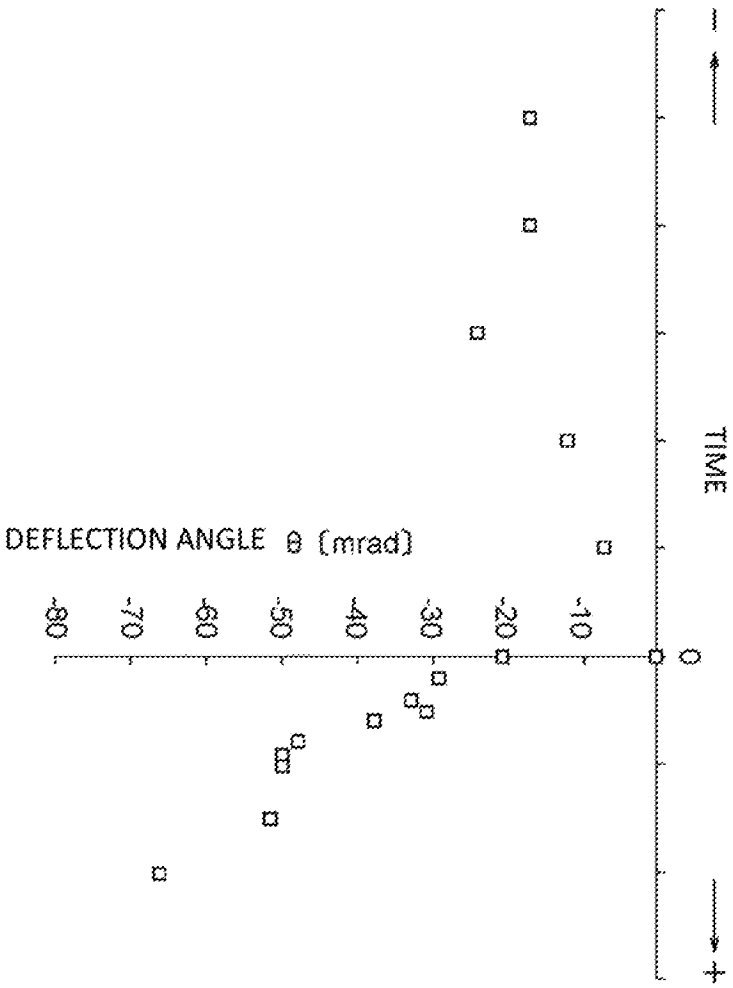
FIG. 8 is a graph illustrating an experimental result of the liquid droplet ejection head in the first embodiment of the invention.

A relationship between the deflection angle θ of the ink droplets ejected from the nozzles 30 and the time Td from the start point of the ejection waveform to the end point of the defection waveform is illustrated in a graph in FIG. 8.

A vertical axis in the graph in FIG. 8 represents the deflection angle θ of the ink droplets ejected from the nozzles 30, and the horizontal axis represents the time Td (refer to FIG. 7A). In the time Td, with a case where the end point of the deflection waveform is the same as the start point of the ejection waveform as a reference ("0"), a case where the end point of the deflection waveform is delayed with respect to the start point of the ejection waveform is defined as "+" and a case where the end point of the deflection waveform is advanced with respect to the start point of ejection waveform is defined as "−". The ejection waveform and the deflection waveform are not changed.

Then, as illustrated in FIG. 8, when the time Td is increased toward the "+" side, the deflection angle θ increases toward the "−" direction side. On the other hand, when the time Td is increased to the "−" side, the deflection angle θ becomes the "−" direction side, but is unstable.

As can be seen from the graphs illustrated in FIGS. 7A, 7B, and 8, the deflection angle θ can be changed by changing the second voltage or time Td.

Flow Path Member

The flow path member 34 is integrally formed with silicon and is superimposed on the main body member 32 on the opposite side of the nozzles 38 in the main body member 32 as illustrated in FIG. 1. In the flow path member 34, a supply flow path 80 extending in the apparatus depth direction and a recovery flow path 84 extending in the apparatus depth direction are formed.

The supply flow path 80 is disposed on the upper side of the ejection unit 50 and extends in the apparatus depth direction. The cross section of the supply flow path 80 has a rectangular shape, and a bottom surface of the supply flow path 80 is configured with an upper surface 33 of the main body member 32. The recovery flow path 84 is disposed on the other side of the supply flow path 80 in the apparatus width direction and on the upper side of the deflection unit 70. The cross section of the recovery flow path 84 has a rectangular shape, and a bottom surface of the recovery flow path 84 is configured with an upper surface 33 of the main body member 32.

Power Source

The power source 56 supplies the power to each unit included in the image forming device 10 (refer to FIG. 10). In the present embodiment, the power source 56 supplies the power voltage having the same magnitude to the first piezoelectric element 52 (refer to FIG. 1) and the second piezoelectric element 72 via the wiring.

Operations

Next, the operations of the liquid droplet ejection head 30 and the like will be described.

First, the ink flowing through the ejector 40 will be described.

The ink flowing through the supply flow path 80 is supplied to each ejector 40 from each auxiliary flow path 48 according to the driving force of a pump (not illustrated), and flows through the first pressure chamber 42, the connecting flow path 46, and the first passage 44 (refer to FIG. 1). Furthermore, the ink flowing through the first passage 44 passes through the upper side of the nozzles 38 and flows through the second passage 64, the connecting flow path 66, the second pressure chamber 62, and the auxiliary flow path 68 of the deflection unit 70, and recovered by the recovery flow path 84.

The start point of the supply flow path 80 and the end point of the recovery flow path 84 are connected to an ink tank (not illustrated), and ink circulates through a flow path including the ejector 40 of each supply flow path 80, and the recovery flow path 84.

Next, a correction of the output image will be described.

Before starting the print job designated by a user, the control unit 36 (refer to FIG. 10) transports the sheet member P and ejects the ink droplets from the liquid droplet ejection head 30 of each color to the sheet member P, and then, creates a test pattern. The reading sensor 37 reads the test pattern formed on the sheet member P. Furthermore, the control unit 36 receives the data read by the reading sensor 37 and checks the presence or absence of non-ejecting nozzles from which the ink droplet is not ejected.

Figure 5:
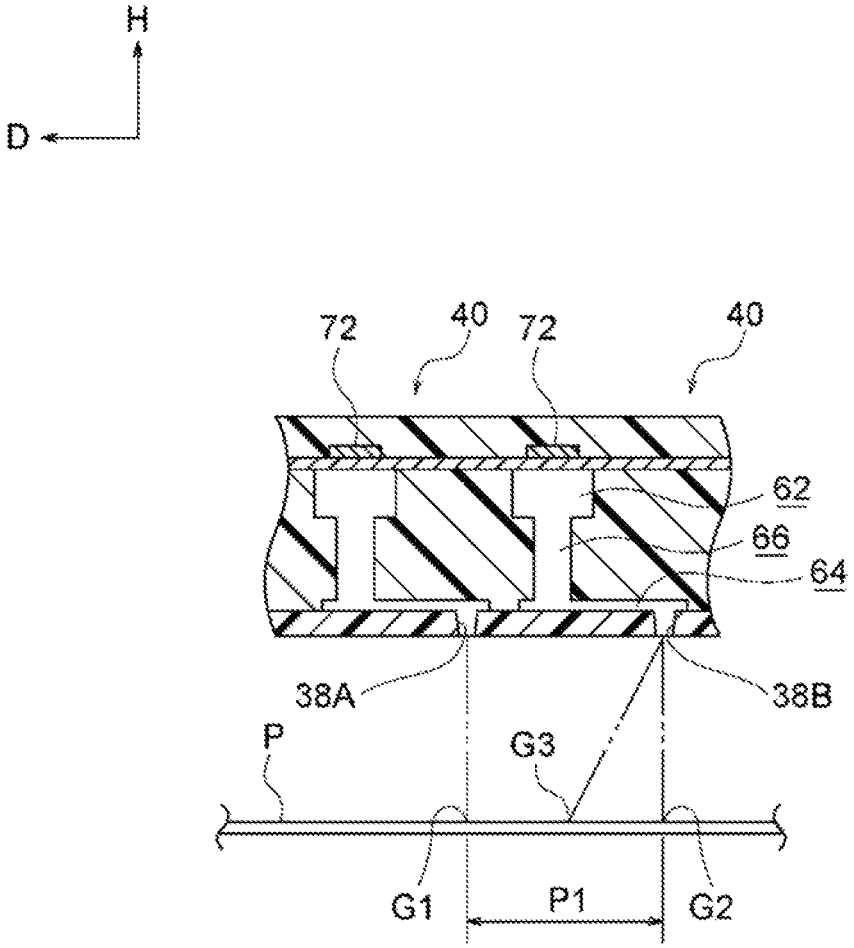
FIG. 5 is a sectional view illustrating the liquid droplet ejection head in the first embodiment of the invention.
Figure 6A:
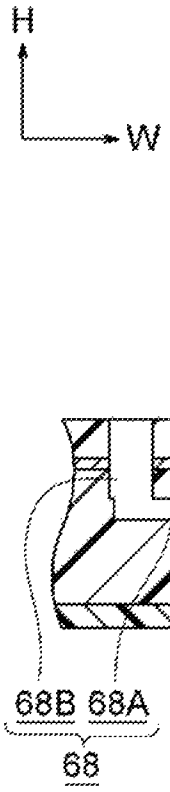
FIGS. 6A to 6C are sectional views illustrating the liquid droplet ejection head in the first embodiment of the invention.
Figure 6B:
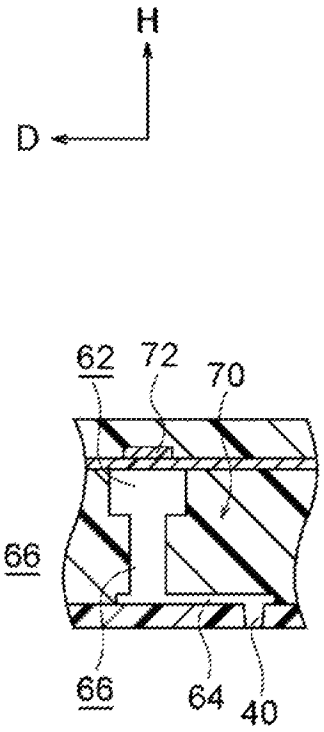
Figure 6C:
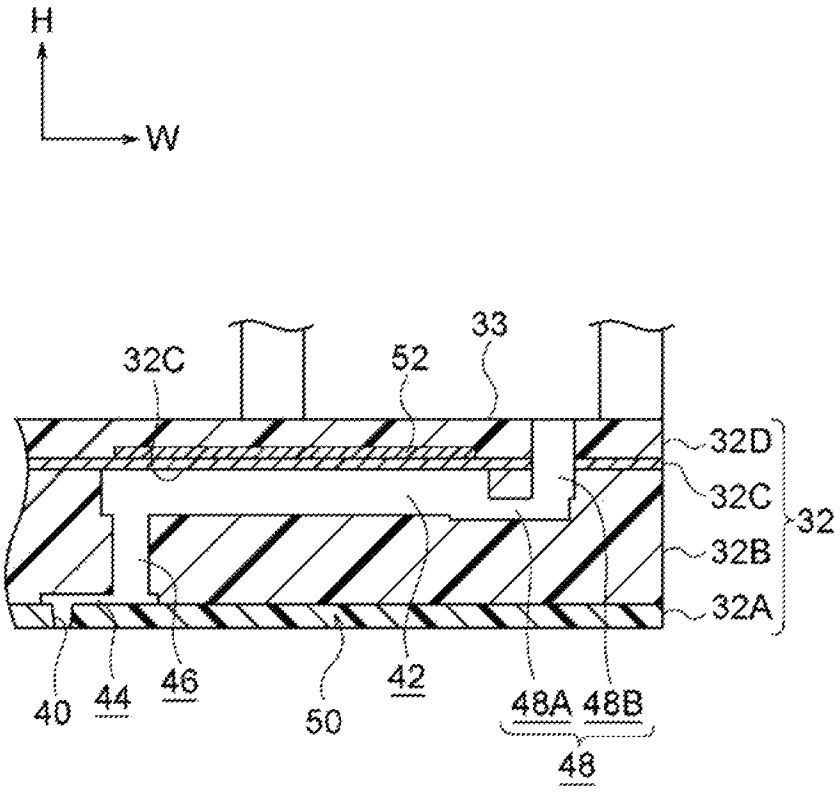

For example, in a case where the nozzle 38 (hereinafter "nozzle 38A") illustrated in FIG. 5 is a non-ejecting nozzle, the control unit 36 applies the voltage to the second piezoelectric element 72 which is linked to the nozzle 38 with respect to the nozzle 38A (hereafter, "nozzle 38B") on the front side in the apparatus depth direction. Then, the control unit 36 changes the ejection direction (deflection angle) of the ink droplets ejected from the nozzles 38B, and lands the ink droplet at a point G3 between a point G1 at which the ink droplet ejected by the nozzles 38A lands and a point G2 at which the ink droplets ejected by the nozzles 38B lands. In this way, by correcting the output image, deterioration in the quality of the output image is suppressed.

SUMMARY

Summary 1

As described above, in the liquid droplet ejection head 30, when viewed from the ejection direction (up and down direction) where the ink droplet is discharged from the nozzles 38, the direction in which the first passage 44 extends and the direction in which the second passage 64 extends intersect each other (refer to FIG. 2).

Here, a liquid droplet ejection head 130 according to a first comparison embodiment will be described with reference to FIG. 11. Regarding the liquid droplet ejection head 130, points different from the liquid droplet ejection head 30 will be mainly described.

Figure 11:
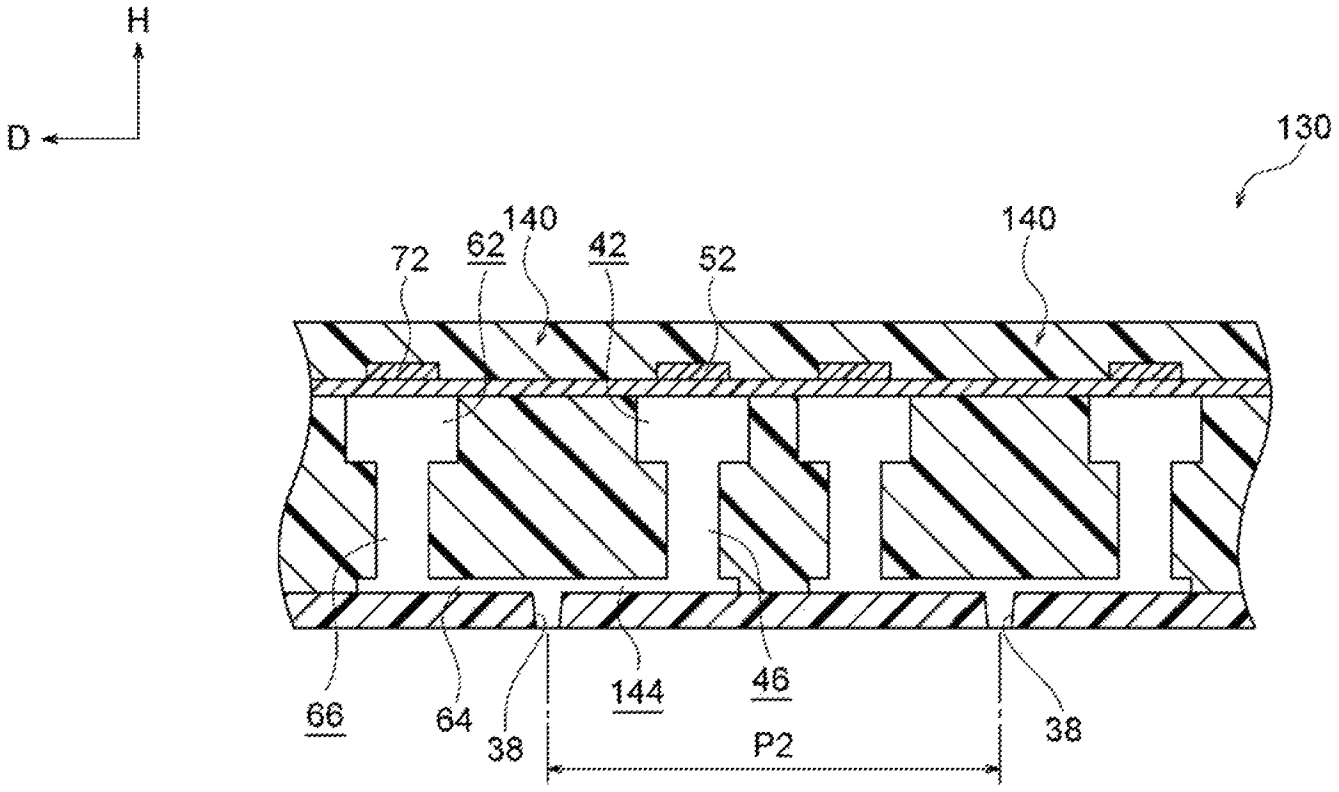
FIG. 11 is a sectional view illustrating a liquid droplet ejection head in a first comparison embodiment of the invention.

In the liquid droplet ejection head 130, when viewed from the ejection direction of the ink droplet from the nozzles 38, the direction in which a first passage 144 of an ejector 140 of the liquid droplet ejection head 130 extends and the direction in which the second passage 64 extends do not intersect each other, but as illustrated in FIG. 11, however, the first passage 144 and the second passage 64 extend in the apparatus depth direction (the sub scanning direction).

As described above, in the first embodiment, when viewed from the upper side, the direction in which the first passage 44 extends and the direction in which the second passage 64 extends intersect each other. As a result, in the apparatus depth direction, the area occupied by the ejector 40 of the liquid droplet ejection head 38 is smaller than the area occupied by the ejector 140 of the liquid droplet ejection head 130. Therefore, as can be seen from FIG. 5 and FIG. 11, a pitch of the nozzle 30 (P1 in FIG. 5) of the liquid droplet ejection head 30 becomes smaller than a pitch of the nozzle 38 of the liquid droplet ejection head 130 (P2 in FIG. 11).

Summary 2

Furthermore, in the liquid droplet ejection head 30, when viewed from the upper side, the first pressure chamber 42 and the second pressure chamber 62 extend in the apparatus width direction (the main scanning direction).

Here, a liquid droplet ejection head 132 according to a second comparison embodiment will be described with reference to FIG. 12. Regarding the liquid droplet ejection head 132, points different from the liquid droplet ejection head 30 will be mainly described.

Figure 12:
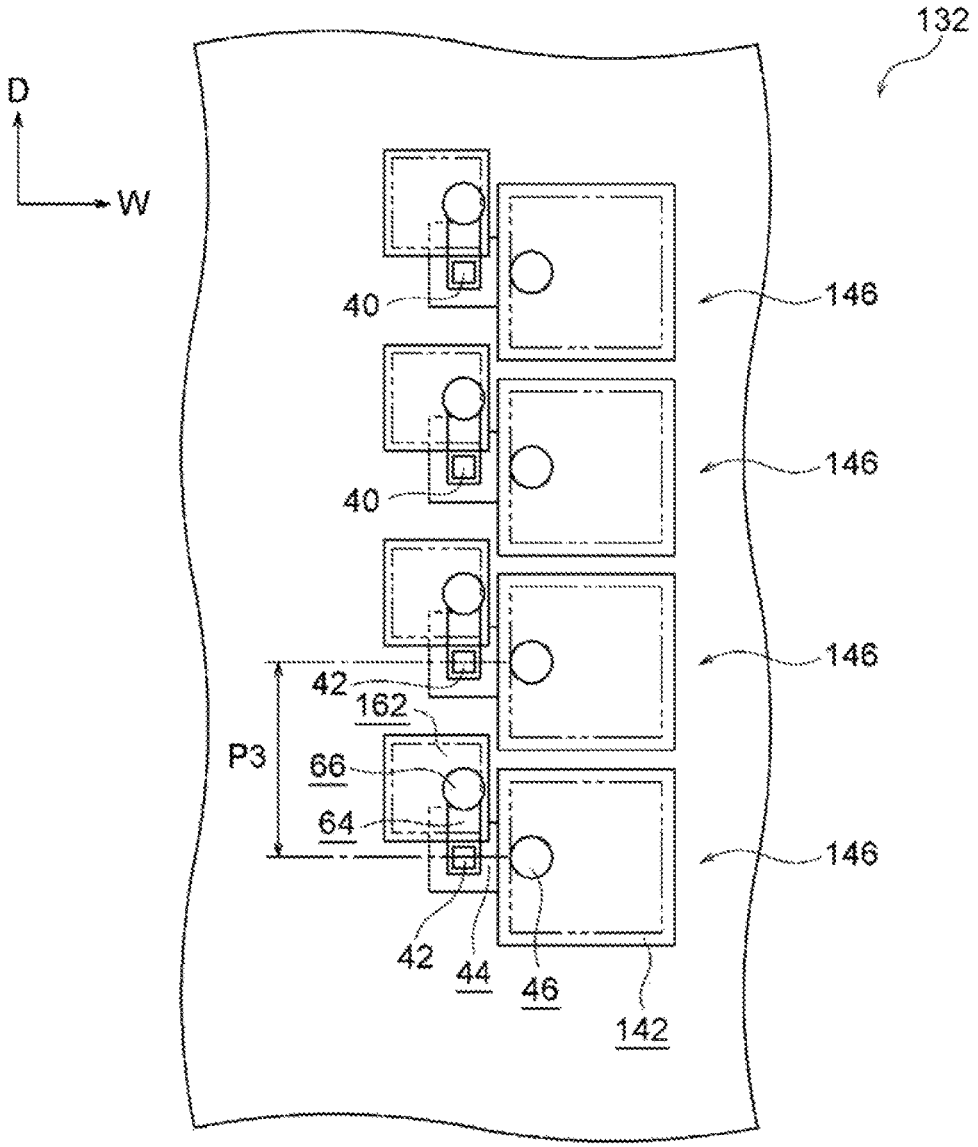
FIG. 12 is a sectional view illustrating a liquid droplet ejection head in a second comparison embodiment of the invention.

As illustrated in FIG. 12, when viewed from the upper side, a first pressure chamber 142 of a second pressure chamber 162 of an ejector 146 and the liquid droplet ejection head 132 have a square shape. The capacity of the first pressure chamber 142 is similar to the capacity of the first pressure chamber 42, and the capacity of the second pressure chamber 162 is similar to the capacity of the second pressure chamber 62.

As a result, in the apparatus depth direction, the area occupied by the ejector 40 of the liquid droplet ejection head 30 becomes smaller than the area occupied by the ejector 146 of the liquid droplet ejection head 132. Therefore, as can be seen from FIG. 2 and FIG. 12, a pitch (P1 in FIG. 2) of the nozzles 38 of the liquid droplet ejection head 30 becomes smaller than a pitch of the nozzles 38 of the liquid droplet ejection head 132 (P3 in FIG. 12).

Summary 3

In addition, in the liquid droplet ejection head 30, the first passage 44 extends in the apparatus width direction (the main scanning direction) and the second passage 64 extends in the apparatus depth direction (the sub scanning direction). Therefore, when viewed from the upper side, the pitch of the adjacent nozzles 38 becomes smaller compared to that in a case where the first passage 44 is inclined in the direction in which the angle made by the first passage 44 and the second passage 64 increases (the direction of the arrow R1 illustrated in FIG. 2) with respect to the main scanning direction.

Summary 4

In addition, in the liquid droplet ejection head 30, the flow path member 34 in which the supply flow path 80 and the recovery flow path 84 are formed is superimposed on the main body member 32 at the opposite side of the nozzles 38 in the main body member 32.

Figure 13:
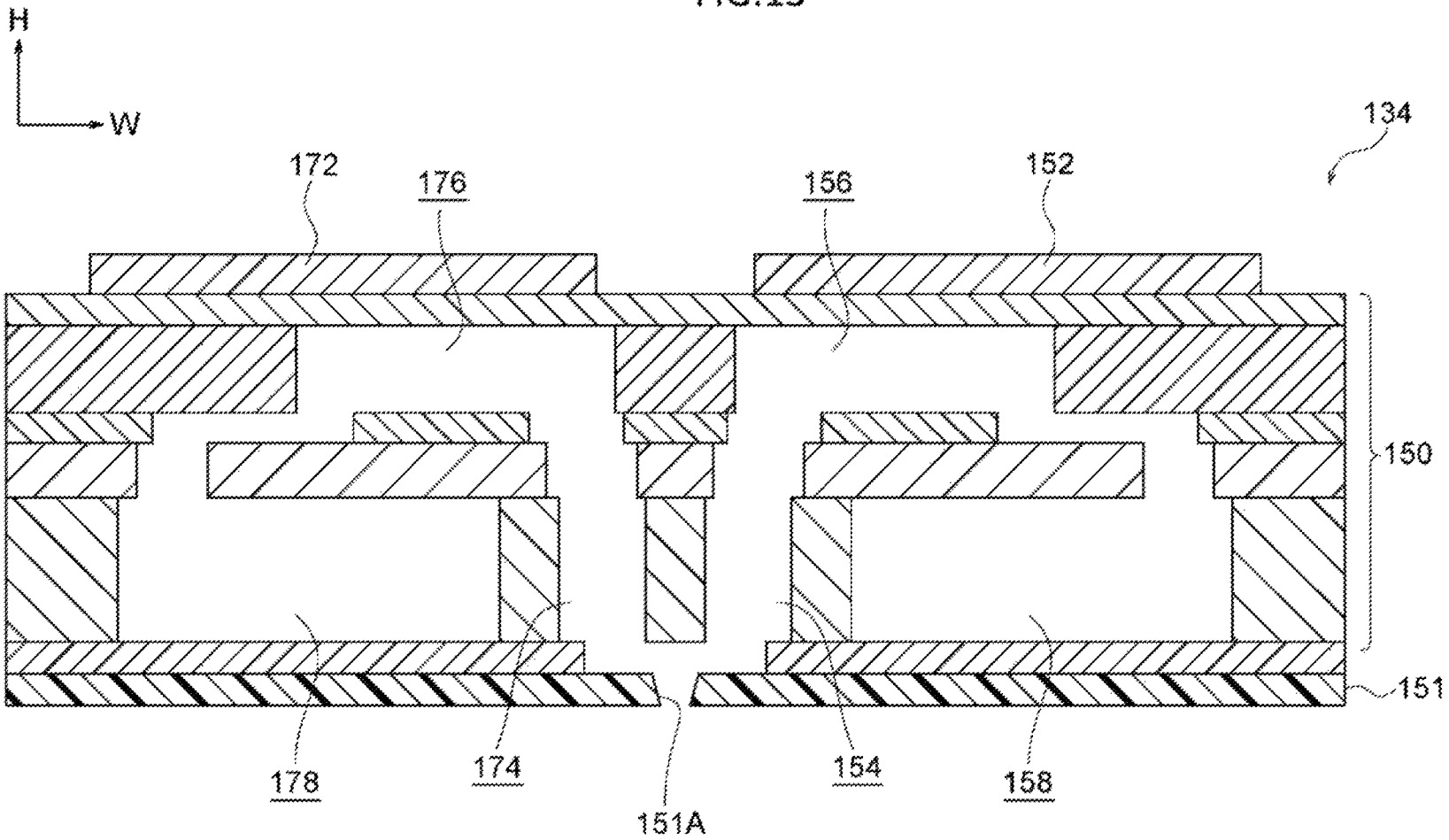
FIG. 13 is a sectional view illustrating a liquid droplet ejection head in a third comparison embodiment of the invention.

Here, a liquid droplet ejection head 134 according to a third comparison embodiment will be described with reference to FIG. 13. The liquid droplet ejection head 134 includes a main body portion 150 in which plural stainless steel etching plates (reference signs omitted) are stacked, a nozzle plate 151 attached to the lower surface of the main body portion 150, a first piezoelectric element 152, and a second piezoelectric element 172.

A nozzle 151A is formed in the nozzle plate 151.

A first passage 154 rising from one end of the nozzle 151A in the apparatus width direction, a first pressure chamber 156 formed at the upper end of the first passage 154, and a supply flow path 158 disposed between the first pressure chamber 156 and the nozzle plate 151, are formed in the main body portion 150. This supply flow path 158 supplies the ink to the first pressure chamber 156.

Furthermore, a second passage 174 rising from the other end of the nozzle 151A in the apparatus width direction, a second pressure chamber 176 formed at the upper end of the second passage 174, and a recovery flow path 178 disposed between the second pressure chamber 176 and the nozzle plate 151, are formed in the main body portion 150. The recovery flow path 178 is configured to recover the ink from the second pressure chamber 176. In addition, the capacity of the second pressure chamber 176 is same as the capacity of the first pressure chamber 156.

Furthermore, the first piezoelectric element 152 is mounted to the opposite side of the first pressure chamber 156 with crossing the ceiling board 150A forming the top surface of the first pressure chamber 156 and the second chamber 176, and the second piezoelectric element 172 is mounted to the opposite side of the second pressure chamber 176 with crossing the ceiling board 150A. That is, in the liquid droplet ejection head 134, the supply flow path 158 and the recovery flow path 178 are disposed between the first pressure chamber 156 and the second pressure chamber 176 and the nozzle 151A in the vertical direction of the apparatus.

In the liquid droplet ejection head 134 in this configuration, a voltage is applied to the first piezoelectric element 152 and the second piezoelectric element 176 by a power source (not illustrated). The voltage applied to the second piezoelectric element 176 is lower than the voltage applied to the first piezoelectric element 152. That is because, if the voltage applied to the first piezoelectric element 152 is equal to the voltage applied to the second piezoelectric element 172, the ink droplets are ejected from the nozzle 151A by the driving of the second piezoelectric element 172 since the capacity of the second pressure chamber 176 the capacity of the first pressure chamber 156 are the same.

Here, as described above, in the liquid droplet ejection head 30, the flow path member 34 in which the supply flow path 80 and the recovery flow path 84 are formed is superimposed on the main body member 32 at the opposite side of the nozzles 38 in the main body member 32. On the other hand, in the liquid droplet ejection head 134, the supply flow path 158 and the recovery flow path 178 are disposed between the first pressure chamber 156 and the second pressure chamber 176 and the nozzle 151A in the vertical direction of the apparatus. Therefore, as can be seen by comparing FIG. 1 and FIG. 13, the liquid droplet ejection head 30 differs from the liquid droplet ejection head 134, and thus, a flow path cross section of the supply flow path 80 and the recovery flow path 84 is determined without being restricted by the respective positions of the first pressure chamber 56, the second pressure chamber 76, and the nozzles 38.

Summary 5

In addition, in the liquid droplet ejection head 30, an electric power of the same voltage is supplied to the first piezoelectric element 52 and the second piezoelectric element 72 from the power source 56. Therefore, as in the liquid droplet ejection head 134 in the third comparison embodiment, the capacity of the second pressure chamber 62 is smaller than the capacity of the first pressure chamber 42 compared to the case where the voltage applied to the second piezoelectric element 176 is smaller than the voltage applied to the first piezoelectric element 152.

In addition, since the capacity of the second pressure chamber 62 is smaller than the capacity of the first pressure chamber 42, the liquid droplet ejection head 30 is downsized compared to the case of using the liquid droplet ejection head 134.

In addition, since the same voltage is applied to the first piezoelectric element 52 and the second piezoelectric element 72, unlike the case of using the liquid droplet ejection head 134, one power source can be used without using a resistor or the like.

Summary 6

In addition, in the liquid droplet ejection head 30, the ink supplied from the supply flow path 80 to the ejection unit 50 flows through the ejection unit 50, passes through the upper side of the nozzles 38, and further flows through the deflection unit 70, and then, recovered by the recovery flow path 84. Therefore, for example, an increase of viscosity of the ink at the upper side of the nozzles 38 can be suppressed compared to the case where the ink flows only through the first pressure chamber 42 and the second pressure chamber 62.

Summary 7

In addition, the ink flowing through the supply flow path 80 flows through the first passage 44, further passes through the upper side of the nozzles 38, flows through the second passage 64, and then, is recovered by the recovery flow path 84. Therefore, for example, an increase of the viscosity of ink ejected from the nozzles 38 as the ink droplets is suppressed compared to the case where the ink supplied from the supply to path 80 flows through the recovery flow path 84 through only the first pressure chamber 42 and the second pressure chamber 62.

Summary 8

In addition, since the image forming device 10 includes the liquid droplet ejection head 30, the pitch of the nozzles 35 can be reduced compared to the case of not including the liquid droplet ejection head 30, and thus, the quality of the output image is improved.

Summary 9

In addition, since the image forming device 10 includes the liquid droplet ejection head 30, the flow path cross section of the supply flow path 80 and the recovery flow path 84 can be determined without being restricted by the each position of the first pressure chamber 42, the second pressure chamber 62, and the nozzles 38. That is, in the image forming device 10, since the flow path cross section of the supply flow path 80 and the recovery flow path 84 is determined in consideration of the ejection performance of the ink droplets from the nozzles 38, the quality of the output image is improved.

Summary 10

In addition, since the image forming device 10 includes the liquid droplet ejection head 30, the apparatus main body can be down-sized because the capacity of the second pressure chamber 62 is smaller than the capacity of the first pressure chamber 42 compared to the case of not including the liquid droplet ejection head 30.

Second Embodiment

Figure 14:
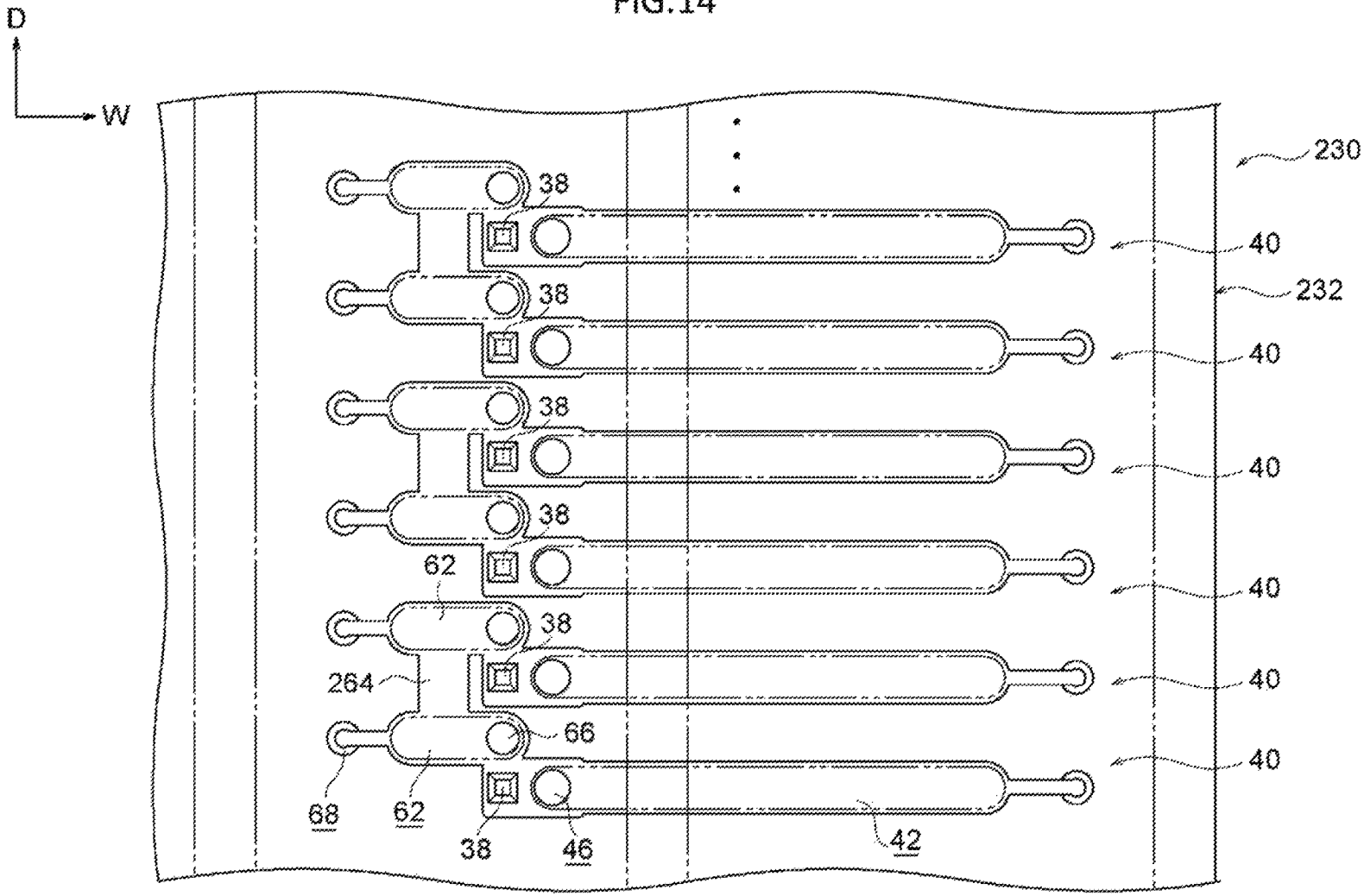
FIG. 14 is a plan view illustrating a liquid droplet ejection head in a second embodiment of the invention.

Next, an example of a liquid droplet ejection head and an image forming apparatus in the second embodiment of the invention will be described with reference to FIG. 14. In the second embodiment, points different from those of the first embodiment will be mainly described.

In a main body member 232 of a liquid droplet ejection head 230 in the second embodiment, a connecting flow path 264 is formed, which connects one second pressure chamber 62 and another second pressure chamber 62 disposed next to one second pressure chamber 62. That is, in the liquid droplet ejection head 230, two second pressure chambers 62 are connected to each other via the connecting flow path 264.

Other operations are similar to those in the first embodiment.

Third Embodiment

Next, an example of a liquid droplet ejection head and an image forming apparatus in a third embodiment of the invention will be described with reference to FIGS. 15 to 17. In the third embodiment, points different from those of the first embodiment will be mainly described.

Configuration

Figure 15:
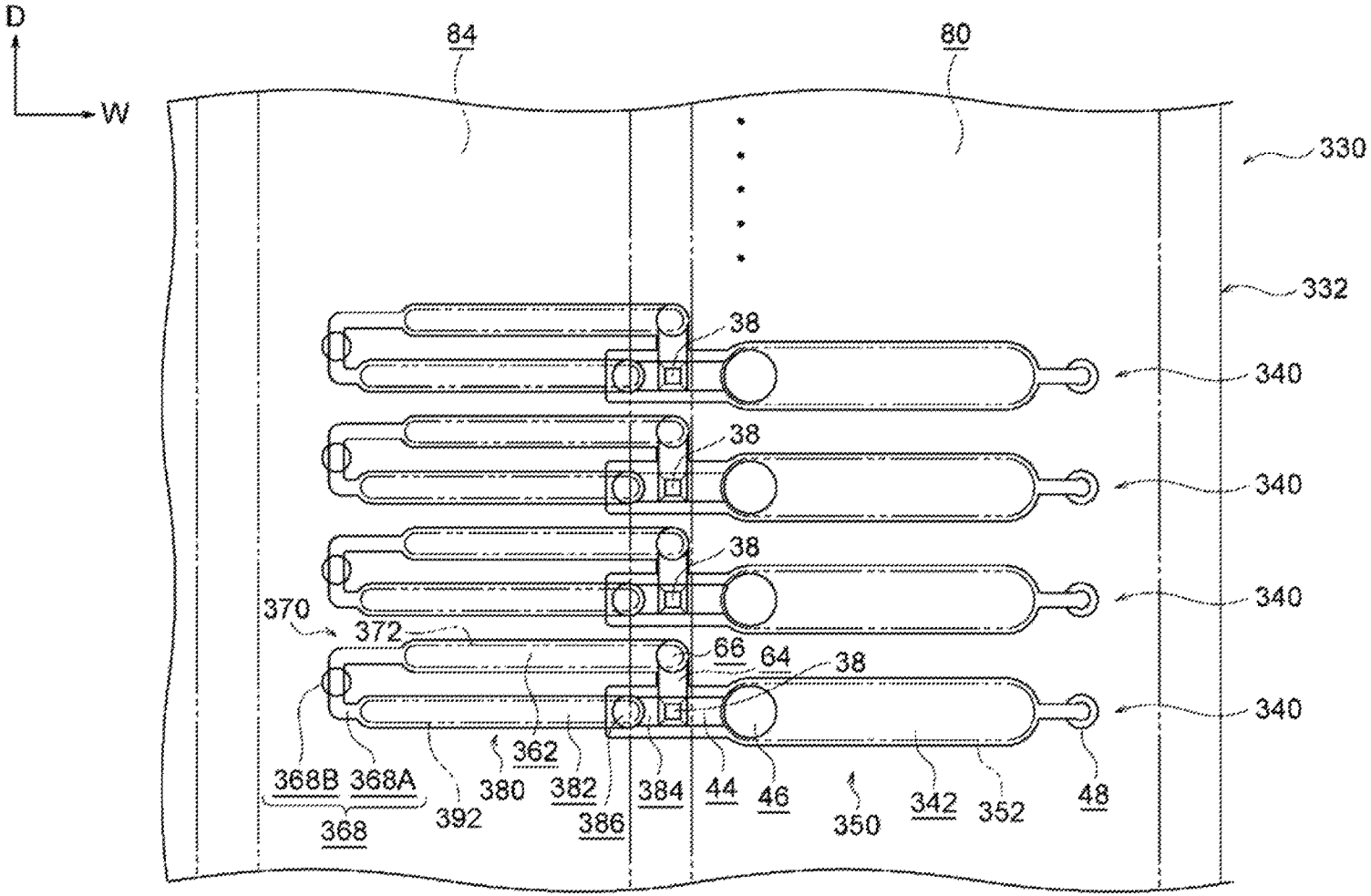
FIG. 15 is a plan view illustrating a liquid droplet ejection head in a third embodiment of the invention.
Figure 16:
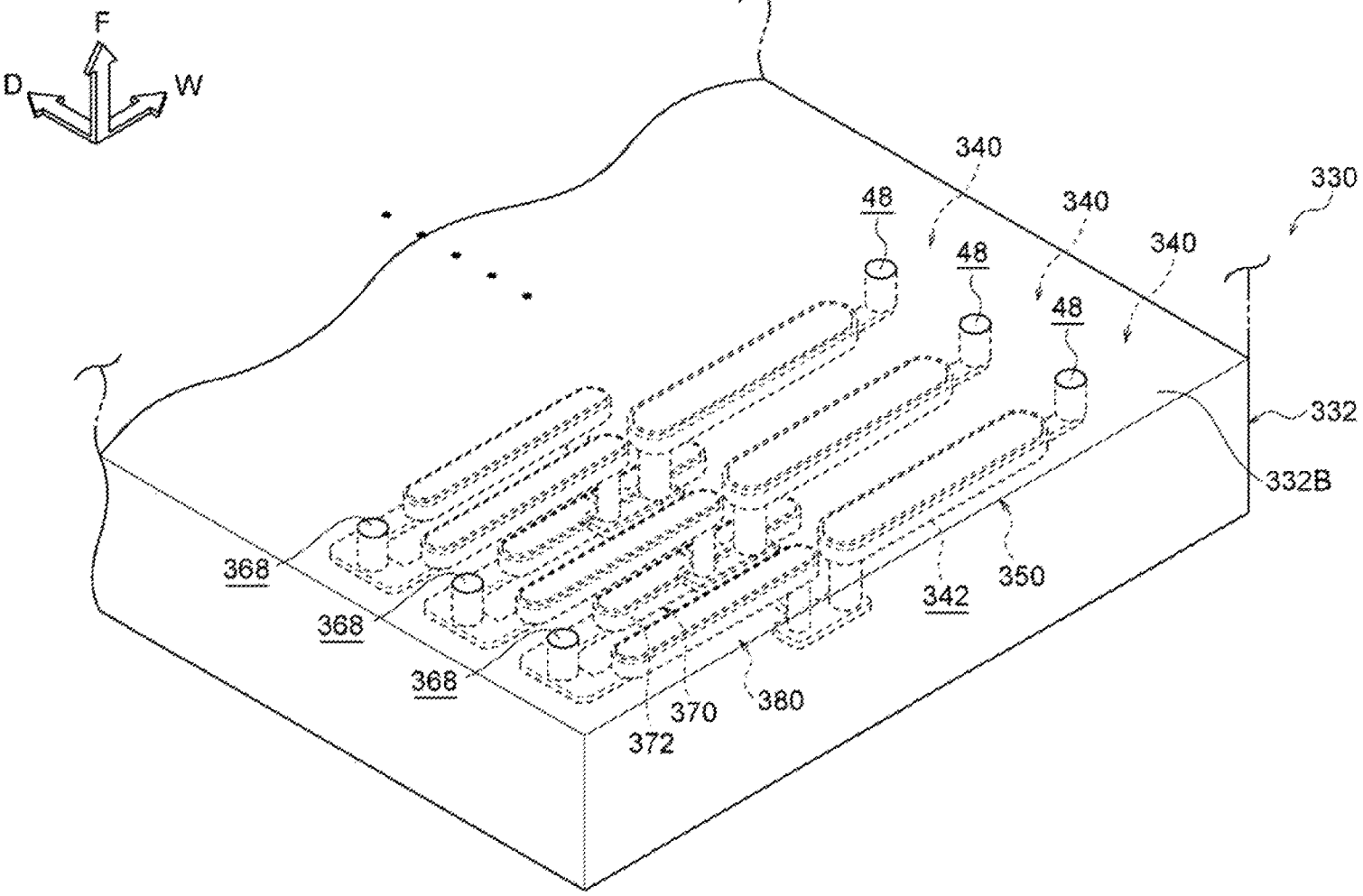
FIG. 16 is a perspective view illustrating the liquid droplet ejection head in the third embodiment of the invention.

As illustrated in FIGS. 15 and 16, plural ejectors 340 arranged in the apparatus depth direction are formed in a main body member 332 of a liquid droplet ejection head 330 in the third embodiment. Each ejector 340 has nozzles 38, an ejection unit 350, a first deflection unit 370, and a second deflection unit 380.

The ejection unit 350 includes a first passage 44, a connecting flow path 46, a first pressure chamber 342 extending to one end of the connecting flow path 46 from the tip in the apparatus width direction, a first piezoelectric element 352 for pressurizing the first pressure chamber 342, and an auxiliary flow path 48.

The first deflection unit 370 includes a second passage 64, a connecting flow path 66, a second pressure chamber 362 extending to the other end of the connecting flow path 66 in the apparatus width direction, a second piezoelectric element 372 for pressurizing the second pressure chamber 362, and an auxiliary flow path 368. The auxiliary flow path 368 will be described later.

The second deflection unit 380 includes a third pressure chamber 382, a third passage 384 linked to the nozzles 38, and a connecting flow path 386 connecting the third pressure chamber 382 and the third passage 384. Furthermore, the second deflection unit 380 includes a third piezoelectric element 392 that pressurizes the third pressure chamber 382 to deflect the ejection direction of the ink droplets ejected from the nozzles 38, and a wiring for applying a voltage to the third piezoelectric element 392 (not illustrated).

Figure 17:
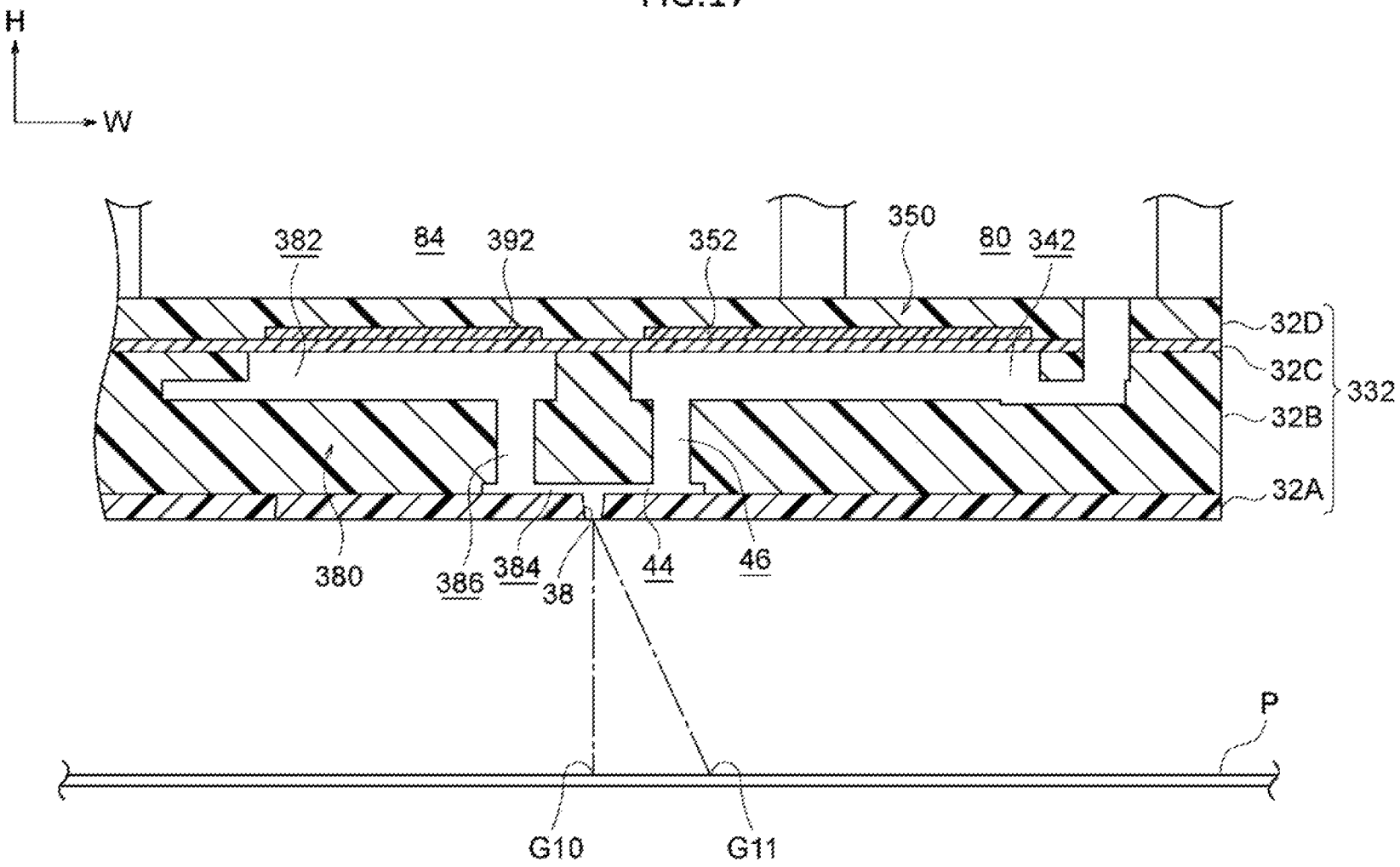
FIG. 17 is a sectional view illustrating the liquid droplet ejection head in the third embodiment of the invention.

As illustrated in FIG. 17, the third passage 384 is thrilled on the lower layer portion 32B and extends to the other side (the left side in the drawing) in the apparatus width direction with the upper end of the nozzles 38 as the base end. The cross section of the third passage 384 has a rectangular shape extending in the apparatus depth direction. The bottom surface forming the third passage 384 is configured with the nozzle plate 32A.

The connecting flow path 386 is formed on the lower layer portion 32B and extends to the upper side with the tip of the third passage 384 as the base end. The cross section of this connecting flow path 386 has a circular shape. The bottom surface forming the connecting flow path 386 is configured with the nozzle plate 32A and the top surface forming the connecting flow path 386 is configured with the vibration plate 32C.

The third pressure chamber 382 is formed on the lower layer portion 32B and extends to the other side in the apparatus width direction with the tip of the connecting flow path 386 as the base end. The cross section of the third pressure chamber 382 has a rectangular shape extending in the apparatus depth direction. In addition, the third pressure chamber 382 is disposed at the front side in the apparatus depth direction with respect to the second pressure chamber 362 (refer to FIG. 15). The top surface forming the third pressure chamber 382 is configured with the vibration plate 32C.

The auxiliary flow path 368 is formed on the lower layer portion 32B, the vibration plate 32C, and the upper layer portion 32D. As illustrated in FIG. 15, the auxiliary flow path 368 includes a horizontal portion 368A one end of which is connected to the tip of the second pressure chamber 362 and the other end of which is connected to the tip of the third pressure chamber 382, and a vertical portion 368B extending to the horizontal portion 368A. The upper end of the vertical portion 368B reaches an upper surface 33 (refer to FIG. 16) of the main body member 32 and the vertical portion 368B is open to the outside of the main body member 32.

The third piezoelectric element 392 is mounted to the opposite side of the third pressure chamber 382 with crossing the vibration plate 32C.

In this configuration, for example, as illustrated in FIG. 17, in a case where the liquid droplet ejected from the nozzle 38 is shifted to one side with respect to a designed target point (G10 in FIG. 17) in the apparatus width direction (G11 in the drawing), a voltage is applied to the third piezoelectric element 392 to deflect the ejection direction of the liquid droplets ejected from the nozzles 38. Specifically the liquid droplets ejected from the nozzles 30 land on the designed target point (G10 in FIG. 17).

Fourth Embodiment

Next, an example of a liquid droplet ejection head and an image forming apparatus in a fourth embodiment of the invention will be described with reference to FIG. 18. In the fourth embodiment, points different from those of the first embodiment will be mainly described.

Figure 18:
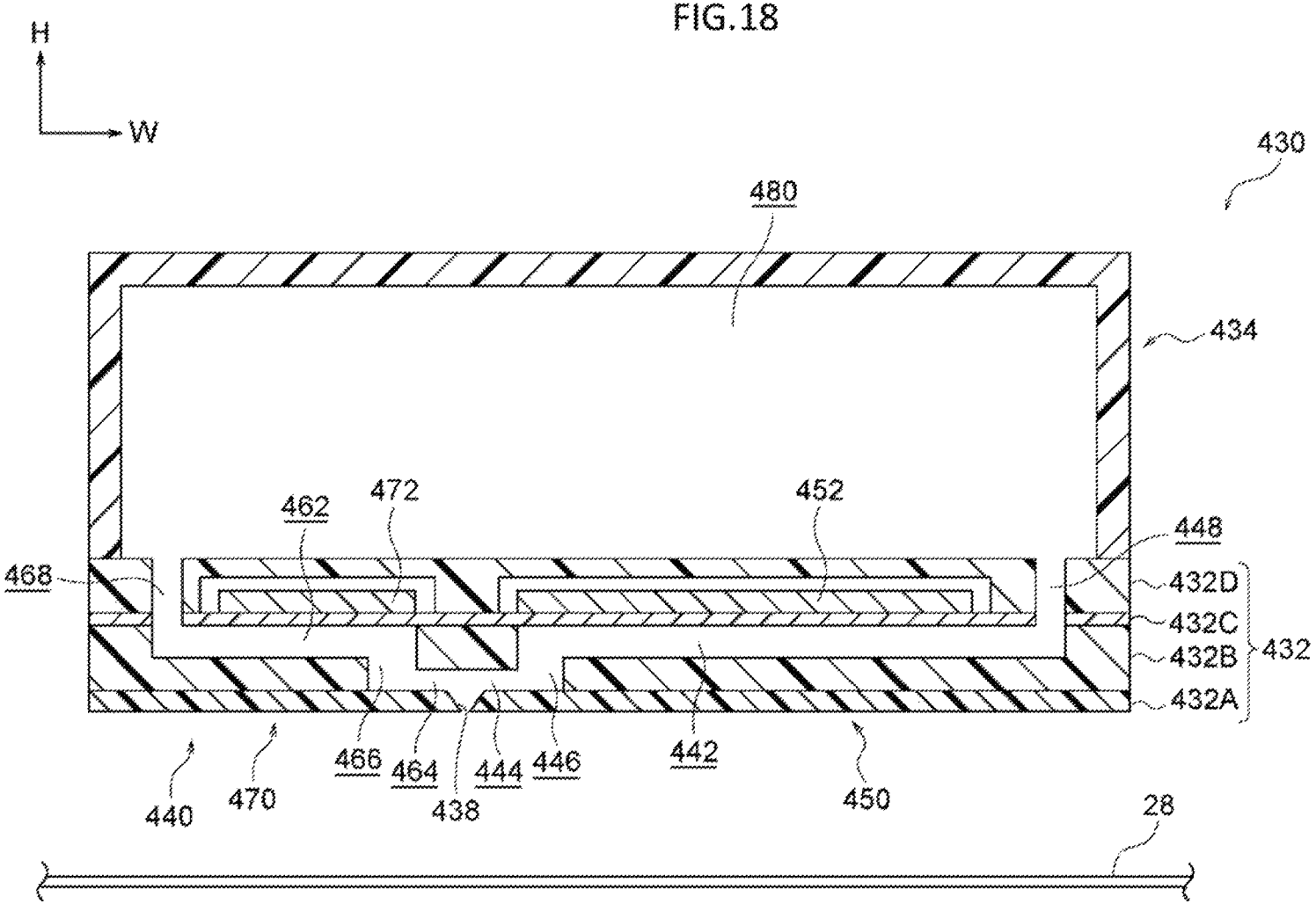
FIG. 18 is a sectional view illustrating a liquid droplet ejection head in a fourth embodiment of the invention.

A liquid droplet ejection head 430 in the fourth embodiment has a rectangular parallelepiped shape extending in the apparatus depth direction, and includes a main body member 432 facing the transport belt 28 carrying the sheet member P as illustrated in FIG. 18, and a flow path member 434 superimposed on the upper side of the main body member 432.

Main Body Member

The main body member 432 has a rectangular parallelepiped shape extending in the apparatus depth direction, and is formed with a nozzle plate 432A, a lower layer portion 432B, a vibration plate 432C, and an upper layer portion 432D that are stacked in this order. The nozzle plate 432A is formed with polyimide resin, and the lower layer portion 432B and the upper layer portion 432D and the vibration plate 432C are formed with silicon. Plural ejectors 440 are disposed on the main body member 432 in the apparatus depth direction (the sub-scanning direction).

The ejector 440 has nozzles 438 for ejecting the ink droplets. The nozzle 438 is formed on the nozzle plate 432A and faces the transport belt 28. Furthermore, the ejector 440 includes an ejection unit 450 disposed on one side (the right side in FIG. 18) in the apparatus width direction with respect to the nozzles 438 and a deflection portion 470 disposed on the other side (the left side in FIG. 8) in the apparatus width direction with respect to the nozzles 438.

Ejection Unit

The ejection unit 450 includes a first pressure chamber 442, a first passage 444 linked to the nozzles 438, a connecting flow path 446 connecting the first pressure chamber 442 and the first passage 444, and an auxiliary flow path 448. Furthermore, the ejection unit 450 includes a first piezoelectric element 452 for pressurizing the first pressure chamber 442 to eject the ink droplet (an example of the liquid droplet) from the nozzles 438, and a wiring (not illustrated) for applying a voltage to the first piezoelectric element 452.

The first passage 444 is formed on the lower layer portion 432B, and extends to one side in the apparatus width direction (main scanning direction) with the upper end of the nozzles 438 as the base end. The connecting flow path 446 is formed on the lower layer portion 432B and extends to the upper side with the tip of the first passage 444 as the base end.

The first pressure chamber 442 is formed on the lower layer portion 432B and extends to one side in the apparatus width direction with the tip of the connecting flow path 446 as the base end. The auxiliary flow path 448 is formed on the lower layer portion 432B, on the vibration plate 432C, and on the upper layer portion 432D, and extends to the upper side with the tip of the first pressure chamber 442 as the base end. The first piezoelectric element 452 is mounted to the opposite side of the first pressure chamber 442 with crossing the vibration plate 432C.

Deflection Unit

The deflection unit 470 includes a second pressure chamber 462, a second passage 464 linked to the nozzles 438, a connecting flow path 466 connecting the second pressure chamber 462 and the second passage 464, and the auxiliary flow path 468. Furthermore, the deflection unit 470 includes a second piezoelectric element 472 which pressurizes the second pressure chamber 462 and deflects the ejection direction of the ink droplets ejected from the nozzles 438, and the wiring (not illustrated) for applying the voltage to the second piezoelectric element 472.

The second passage 464 is formed on the lower layer portion 432B and extends to the other side in the apparatus width direction with the upper end of the nozzles 438 as the base end. The connecting now path 466 is formed on the lower layer portion 432B and extends to the upper side with the tip of the second passage 464 as the base end.

The second pressure chamber 462 is formed on the lower layer portion 432B and extends to the other side of the apparatus width direction with the tip of the connecting flow path 466 as the base end. The auxiliary flow path 468 is formed on the lower layer portion 432B, on the vibration plate 432C, and on the upper layer portion 432D, and extends to the upper side with the tip of the second pressure chamber 462 as the base end. In addition, the second piezoelectric element 472 is mounted to the opposite side of the second pressure chamber 462 with crossing the vibration plate 432C.

Flow Path Member

The flow path member 434 is integrally formed with silicon and is superimposed on the main body member 432 on the opposite side of the nozzles 438 in the main body member 432. In the flow path member 434, a supply flow path 480 extending in the apparatus depth direction is formed.

In this configuration, the ink flowing through the supply flow path 480 is supplied from the auxiliary flow path 448 to the ejection unit 450 and is supplied from the auxiliary flow path 468 to the deflection unit 470.

Summary

In the liquid droplet ejection head 430, the flow path member 434 in which the supply flow path 480 is formed is superimposed on the main body member 432 on the side opposite to the nozzle 438 in the main body member 432. Therefore, in the liquid droplet ejection head 430, the flow path cross section of the supply flow path 450 is determined without being restricted by the respective positions of the first pressure chamber 442, the second pressure chamber 462, and the nozzle 438.

Fifth Embodiment

Next, an example of a liquid droplet ejection head and an image forming apparatus in a fifth embodiment of the invention will be described with reference to FIG. 19. In the fifth embodiment, points different from those of the first embodiment will be mainly described.

Figure 19:
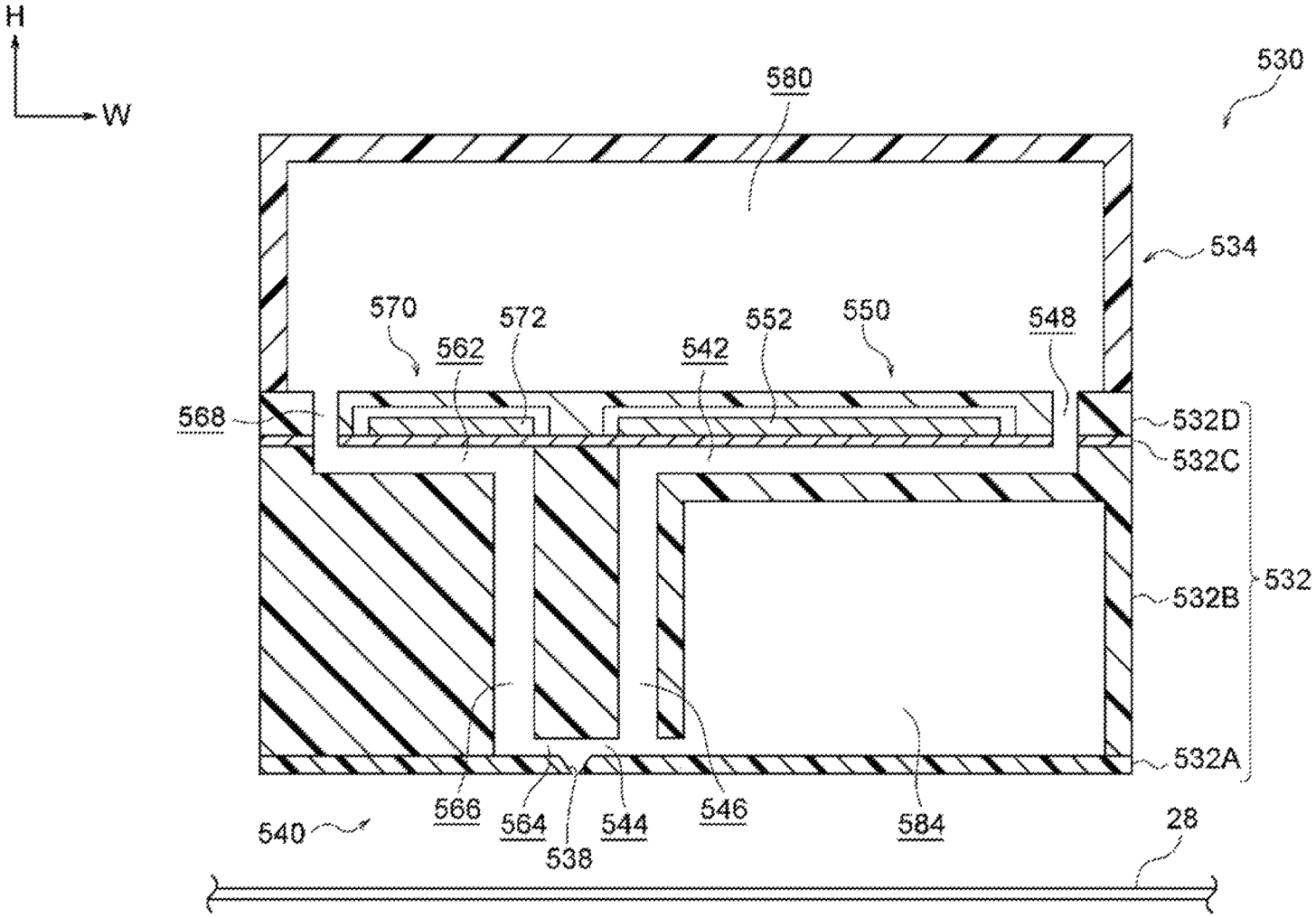
FIG. 19 is a sectional view illustrating to liquid droplet ejection head in a fifth embodiment of the invention.

A liquid droplet ejection head 530 in the fifth embodiment has a rectangular parallelepiped shape extending in the apparatus depth direction, and includes a main body member 532 facing the transport belt 28 transporting the sheet member P as illustrated in FIG. 19, and a flow path member 534 superimposed on the upper side of the main body member 532.

Main Body Member

The main body member 532 has a rectangular parallelepiped shape extending in the apparatus depth direction, and is formed with a nozzle plate 532A, a lower layer portion 532B, a vibration plate 532C, and an upper layer portion 532D that are stacked in this order. The nozzle plate 532A, the lower layer portion 532B, the upper layer portion 532D, and the vibration plate 532C are formed with silicon. Plural ejectors 540 are disposed on the main body member 532 in the apparatus depth direction (the sub-scanning direction).

The ejector 540 has nozzles 538 for ejecting the ink droplets. The nozzle 538 is formed on the nozzle plate 532A and faces the transport belt 28. Furthermore, the ejector 540 includes an ejection unit 550 disposed on one side (the right side in FIG. 19) in the apparatus width direction with respect to the nozzles 538 and a deflection unit 570 disposed on the back side (the left side in FIG. 19) in the apparatus width direction with respect to the nozzles 538.

Ejection Unit

The ejection unit 550 includes a first pressure chamber 542, a first passage 544 linked to the nozzles 538, a connecting flow path 546 connecting the first pressure chamber 542 and the first passage 544, and an auxiliary flow path 548. Furthermore, the ejection unit 550 includes a first piezoelectric element 552 for pressurizing the first pressure chamber 542 to eject the ink droplet (an example of the liquid droplet) from the nozzles 538, and a wiring (not illustrated) for applying a voltage to the first piezoelectric element 552.

The first passage 544 is formed on the lower layer portion 532B, and extends to one side in the apparatus width direction (main scanning direction) with the upper end of the nozzles 538 as the base end. The connecting flow path 546 is formed on the lower layer portion 532B and extends to the upper side with the tip of the first passage 544 as the base end.

The first pressure chamber 542 is formed on the lower layer portion 532B and extends to one side in the apparatus width direction with the tip of the connecting flow path 546 as the base end. The auxiliary flow path 548 is formed on the lower layer portion 532B, on the vibration plate 532C, and on the upper layer portion 532D, and extends to the upper side with the tip of the first pressure chamber 542 as the base end. The first piezoelectric element 552 is mounted to the opposite side of the first pressure chamber 542 with crossing the vibration plate 532C.

Deflection Unit

The deflection unit 570 includes a second pressure chamber 562, a second passage 564 linked to the nozzles 538, a connecting flow path 566 connecting the second pressure chamber 562 and the second passage 564, and the auxiliary flow path 568. Furthermore, the deflection unit 570 includes a second piezoelectric element 572 which pressurizes the second pressure chamber 562 and deflects the ejection direction of the ink droplets ejected from the nozzles 538, and the wiring (not illustrated) for applying the voltage to the second piezoelectric element 572.

The second passage 564 is formed on the lower layer portion 532B and extends to the other side in the apparatus width direction with the upper end of the nozzles 538 as the base end. The connecting flow path 566 is formed on the lower layer portion 532B and extends to the upper side with the tip of the second passage 564 as the base end.

The second pressure chamber 562 is formed on the lower layer portion 532B and extends to the other side of the apparatus width direction with the tip of the connecting flow path 566 as the base end. The auxiliary flow path 568 is formed on the lower layer portion 532B, on the vibration plate 532C, and on the upper layer portion 532D, and extends to the upper side with the tip of the second pressure chamber 562 as the base end. In addition, the second piezoelectric element 572 is mounted to the opposite side of the second pressure chamber 562 with crossing the vibration plate 532C.

Others

The recovery flow path 584 is formed on the lower layer portion 532B and is disposed at the lower side of the first pressure chamber 542 and extends in the apparatus depth direction. The recovery flow path 584 is linked to the tip of the first passage 544.

Flow Path Member

The flow path member 534 is integrally formed with silicon and is superimposed on the main body member 532 an the opposite side of the nozzles 538 in the main body member 532. In the flow path member 534, a supply flow path 580 extending in the apparatus depth direction and linked to the auxiliary flow paths 548 and 568 is formed.

In this configuration, the ink flowing through the supply flow path 580 is supplied from the auxiliary flow path 548 to the ejection unit 550 and is supplied from the auxiliary flow path 568 to the deflection unit 570. The ink supplied to the ejection unit 550 and the deflection unit 570 flows through the first passage 544 and are recovered by the recovery flow path 584.

Summary

In the liquid droplet ejection head 530, the flow path member 534 in which the supply flow path 580 is formed is superimposed on the main body member 532 on the side opposite to the nozzle 538 in the main body member 532. Therefore, the flow path cross section of the supply flow path 580 is determined without being restricted by the respective positions of the first pressure chamber 542, the second pressure chamber 562 and the nozzle 538.

Sixth Embodiment

Figure 20:
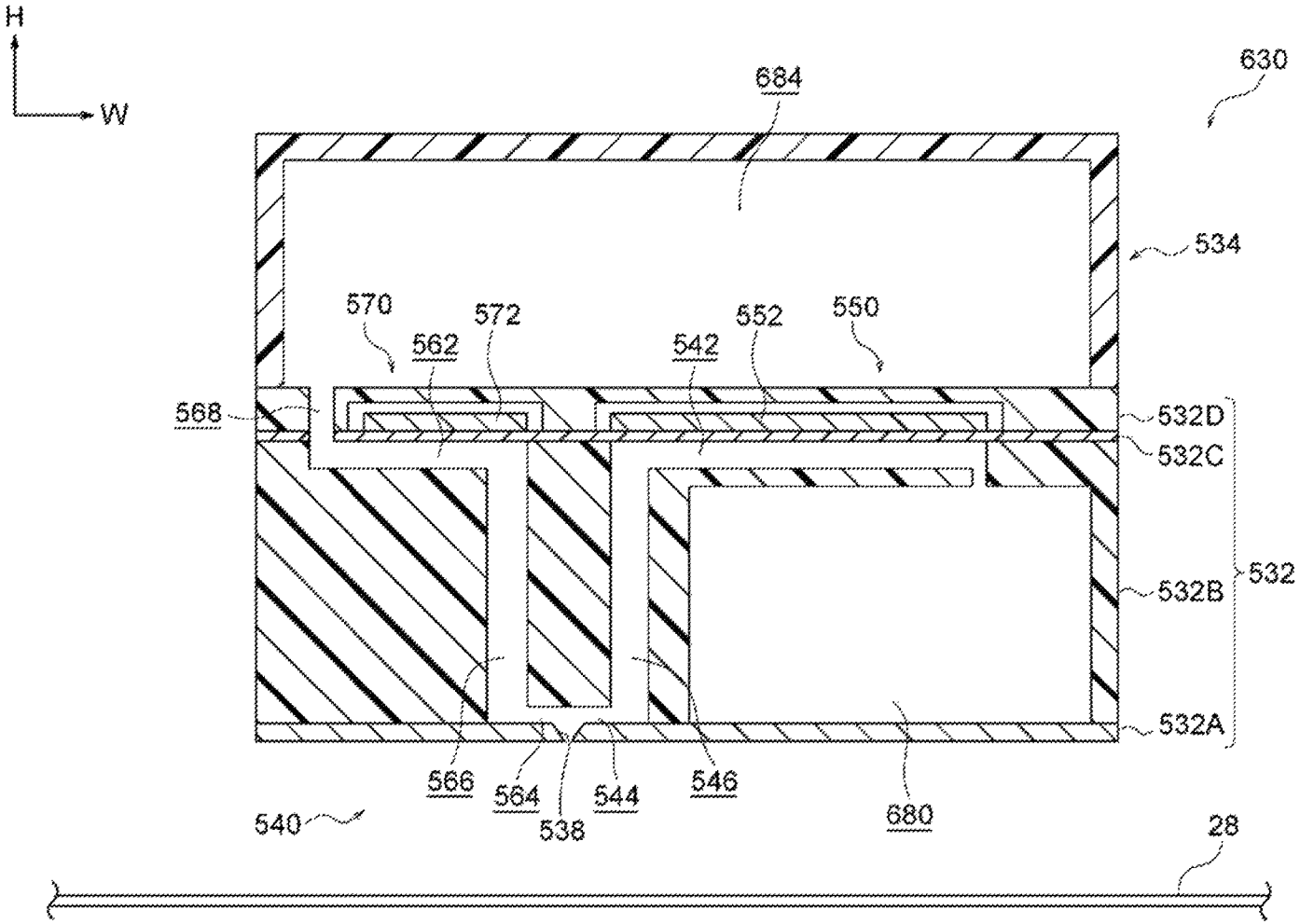
FIG. 20 is a sectional view illustrating a liquid droplet ejection head in a sixth embodiment of the invention.

Next, an example of a liquid droplet ejection head and an image forming apparatus in a sixth embodiment of the invention will be described with reference to FIG. 20. In the sixth embodiment, points different from those of the fifth embodiment will be mainly described.

A supply flow path 680 if the liquid droplet ejection head 630 in the sixth embodiment is formed on the lower layer portion 532B and is disposed at the lower side of the first pressure chamber 542 and extends in the apparatus depth direction. The supply flow path 680 is linked to the tip of the first pressure chamber 542. In addition, the recovery flow path 684 is formed on the flow path member 534, extends in the apparatus depth direction, and is linked to the auxiliary flow path 568. The ejection unit 450 of the liquid droplet ejection head 630 does not have an auxiliary flow path linked to the recovery flow path 684.

In this configuration, the ink flowing through the supply flow path 680 is supplied from the first pressure chamber 542 to the ejection unit 550, and then, is supplied to the deflection unit 570. The ink supplied to deflection unit 570 flows through the auxiliary flow path 568 and is collected by recovery flow path 684.

Summary

In the liquid droplet ejection head 630, the flow path member 534 in which the recovery flow path 684 is formed is superimposed on the main body member 532 on the side opposite to the nozzle 538 in the main body member 532. Therefore, the flow path cross section of the recovery flow path 684 is determined without being restricted by the respective positions of the first pressure chamber 542, the second pressure chamber 562, and the nozzle 538.

The specific embodiments of the invention have been described in detail. However, it is apparent for those skilled in the art that the invention is not limited to the embodiments and various other embodiments can be made within the scope of the invention. For example, in the first, second and third embodiments, the supply flow path and the recovery flow path may be interchanged such that the ink flows in the reverse direction.

In addition, in the embodiments described above, although not specifically described, the nozzles aligned in the apparatus depth direction are formed on the liquid droplet ejection head. However, plural nozzle arrays arranged in the apparatus depth direction may be arranged in the apparatus width direction.

In the embodiments described above, the image forming apparatus has been described as an example of the liquid droplet ejection apparatus. However, a 3D printer or the like may be an example of the liquid droplet ejection apparatus.

In addition, in the embodiments described above, the voltages of the same magnitude are applied to the first piezoelectric elements 52, 352, 452, and 552 and the second piezoelectric elements 72, 372, 472, and 572. However, the voltages may be different from each other as long as the voltage applied to the second piezoelectric elements 72, 372, 472, and 572 is equal to or higher than the voltage applied to the first piezoelectric elements 52, 352, 452, and 552. However, in this case, there is no effect generated by applying the voltages of the same magnitude to the first piezoelectric elements 52, 352, 452, and 552 and the second piezoelectric elements 72, 372, 472, and 572.

In the embodiments described above, the number of pressure chambers is two or three with respect to one nozzle, but there may be plural pressure chambers for one nozzle.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejection head comprising:

a main body member that includes a nozzle that ejects a liquid droplet, a first pressure chamber that is linked to the nozzle, and a second pressure chamber that is linked to the nozzle, a capacity of the second pressure chamber being smaller than a capacity of the first pressure chamber;

a first piezoelectric element that pressurizes the first pressure chamber by applying a first voltage, and causes the liquid droplet to be ejected from the nozzle; and a second piezoelectric element that pressurizes the second pressure chamber by applying a second voltage which is equal to or higher than the first voltage, and deflects the direction of the liquid droplets ejected from the nozzle.

2. The liquid droplet ejection head according to claim 1, wherein the first voltage applied to the first piezoelectric element is the same as the second voltage applied to the second piezoelectric element.

3. The liquid droplet ejection head according to claim 1, wherein the main body member includes a plurality of nozzles that eject liquid droplets and a plurality of pairs of the first pressure chamber and the second pressure chamber each linked to one of the nozzles;

wherein the nozzles eject the liquid droplets toward an ejection targeted member transported in the main scanning direction, wherein the nozzles are aligned in a sub-scanning direction intersecting a main scanning direction, and wherein the first pressure chambers and the second pressure chambers extend in the main scanning direction.

4. The liquid droplet ejection head according to claim 3, wherein the main body member includes first passages through which liquid flowing from the first pressure chambers to the nozzle passes, and second passages through which liquid flowing from the second pressure chambers to the nozzle passes, and wherein the first passages extend in the main scanning direction and the second passages extend in the sub-scanning direction.

5. The liquid droplet ejection head according to claim 1, further comprising:

a flow path member disposed on the opposite side to the nozzle in the main body member, the flow path member comprising a supply flow path for supplying the liquid to at least one of the first pressure chamber or the second pressure chamber.

6. The liquid droplet ejection head according to claim 1, further comprising:

a flow path member disposed on the opposite side to the nozzle in the main body member, the flow path member comprising a recovery flow path for recovering the liquid from at least one of the first pressure chamber or the second pressure chamber.

7. A liquid droplet ejection head comprising:

a main body member that includes a nozzle that ejects a liquid droplet, and a first pressure chamber that is linked to the nozzle and a second pressure chamber that is linked to the nozzle;

a first piezoelectric element that pressurizes the first pressure chamber;

a second piezoelectric element that pressurizes the second pressure chamber; and a flow path member disposed on the opposite side to the nozzle in the main body member, the flow path member including a supply flow path for supplying the liquid to the first pressure chamber or the second pressure chamber and a recovery flow path for recovering the liquid from the first pressure chamber or the second pressure chamber.

8. The liquid droplet ejection head according to claim 7, wherein the main body member includes a first passage through which liquid flowing from the first pressure chamber to the nozzle passes, and a second passage through which liquid flowing from the second pressure chamber to the nozzle passes, and wherein the liquid supplied from the supply flow path passes through the first passage and the second passage and is recovered through the recovery flow path.

9. The liquid droplet ejection head according to claim 8, wherein the main body member includes a plurality of nozzles that eject liquid droplets, a plurality of pairs of the first pressure chamber and the second pressure chamber each linked to one of the nozzles, a plurality of first passages through which liquid flowing from the first pressure chamber to the nozzle passes, and a plurality of the second passages through which liquid flowing from the second pressure chamber to the nozzle passes;

wherein the nozzles eject the liquid droplets toward an ejection targeted member transported in the main scanning direction, wherein the nozzles are aligned in a sub-scanning direction intersecting a main scanning direction, and wherein the direction in which the first passages extend intersects the direction in which the second passages extend.

10. A liquid droplet ejection head comprising:

a main body member that includes a nozzle that ejects a liquid droplet, a first pressure chamber that is linked to the nozzle via a first passage and a second pressure chamber that is linked to the nozzle via a second passage, a capacity of the second pressure chamber being smaller than a capacity of the first pressure chamber;

a first piezoelectric element that pressurizes the first pressure chamber and causes the liquid droplet to be ejected from the nozzle, and a second piezoelectric element that pressurizes the second pressure chamber and deflects the direction of the liquid droplet ejected from the nozzle, wherein the direction in which the first passage extends intersects the direction in which the second passage extends.

11. The liquid droplet ejection head according to claim 10, wherein the main body member includes a plurality of nozzles that eject liquid droplets and a plurality of pairs of the first pressure chamber and the second pressure chamber each linked to one of the nozzles;

wherein the nozzles eject the liquid droplets toward an ejection targeted member transported to the main scanning direction, wherein the nozzles are aligned in a sub-scanning direction intersecting a main scanning direction, and wherein the first pressure chambers and the second pressure chambers extend in the main scanning direction.

12. The liquid droplet ejection head according to claim 11, wherein the first passages extends in the main scanning direction and the second passages extend in the sub-scanning direction.

13. The liquid droplet ejection head according to claim 12, wherein the main body member further includes a plurality of third pressure chambers linked to each of the nozzles via third passages, wherein the liquid droplet ejection head further comprises a third piezoelectric element that pressurizes the third pressure chambers and deflects the direction of the liquid droplets ejected from the nozzles, and wherein the third passages extend in the main scanning direction on the side opposite to the first passages with respect to the nozzles.

14. The liquid droplet ejection head according to claim 10, further comprising:

a flow path member disposed on the opposite side to the nozzle in the main body member, the flow path member including a supply flow path for supplying the liquid to at least one of the first pressure chamber or the second pressure chamber.

15. The liquid droplet ejection head according to claim 10, further comprising:

a flow path member disposed on the opposite side to the nozzle in the main body member, the flow path member including a recovery flow path for recovering the liquid from at least one of the first pressure chamber or the second pressure chamber.

* * * * *